US009430907B2

(12) United States Patent
Vann

(10) Patent No.: US 9,430,907 B2
(45) Date of Patent: Aug. 30, 2016

(54) INCORPORATING A SECONDARY GAME WITH A LOYALTY PROGRAM

(71) Applicant: WMS Gaming, Inc., Waukegan, IL (US)

(72) Inventor: Jamie W. Vann, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

(21) Appl. No.: 14/274,392

(22) Filed: May 9, 2014

(65) Prior Publication Data

US 2014/0335943 A1 Nov. 13, 2014

Related U.S. Application Data

(60) Provisional application No. 61/822,202, filed on May 10, 2013.

(51) Int. Cl.
*A63F 9/24* (2006.01)
*G07F 17/32* (2006.01)

(52) U.S. Cl.
CPC ..... *G07F 17/326* (2013.01); *G07F 17/3267* (2013.01)

(58) Field of Classification Search
CPC .. G07F 17/34; G07F 17/3267; G07F 17/326; G07F 17/3239; G07F 17/3258; G07F 17/3262
See application file for complete search history.

(56) References Cited

U.S. PATENT DOCUMENTS 4,837,728 A 6/1989 Barrie et al.
5,231,568 A 7/1993 Cohen et al.
5,373,440 A 12/1994 Cohen et al.
5,393,057 A 2/1995 Marnell, II
5,397,125 A 3/1995 Adams
5,564,700 A 10/1996 Celona
5,707,285 A 1/1998 Place et al.
5,941,772 A 8/1999 Paige
5,947,820 A 9/1999 Morro et al.
6,068,553 A 5/2000 Parker
6,113,098 A 9/2000 Adams
6,523,824 B1 2/2003 Colapinto et al.
6,540,609 B1 4/2003 Paige
6,579,178 B1 * 6/2003 Walker ..... G07F 17/32 273/138.2
6,609,970 B1 8/2003 Luciano, Jr.
6,648,761 B1 11/2003 Izawa et al.
6,843,720 B2 1/2005 Luciano et al.
6,875,107 B1 4/2005 Luciano, Jr.

(Continued)

FOREIGN PATENT DOCUMENTS

GB 2364418 1/2002
JP 201339341 2/2013

*Primary Examiner* — Steve Rowland
(74) *Attorney, Agent, or Firm* — DeLizio Law, PLLC

(57) ABSTRACT

A wagering game system and its operations are described herein. In some embodiments, the operations can include providing a secondary game for presentation. A game objective for the secondary game is associated with a set of achievements attainable via wagering games available for play via a wagering game machine. The operations can further include detecting attainment of one of the set of achievements via one of the wagering games. The attainment of the one of the set of achievements causes completion of the game objective for the secondary game. The operations can further include awarding a prize associated with a customer loyalty program based on the completion of the game objective.

23 Claims, 12 Drawing Sheets

(56) References Cited

U.S. PATENT DOCUMENTS

| | | | | |
|---|---|---|---|---|
| 6,890,256 | B2 | 5/2005 | Walker et al. | |
| 6,899,626 | B1 | 5/2005 | Luciano et al. | |
| 7,008,320 | B2 | 3/2006 | Rowe et al. | |
| 7,008,321 | B2 | 3/2006 | Rowe et al. | |
| 7,025,674 | B2 | 4/2006 | Adams et al. | |
| 7,320,641 | B2 | 1/2008 | Luciano, Jr. | |
| 7,455,586 | B2 | 11/2008 | Nguyen et al. | |
| 7,485,040 | B2 | 2/2009 | Walker et al. | |
| 7,862,420 | B2 | 1/2011 | Peterson et al. | |
| 7,993,197 | B2 | 8/2011 | Kaminkow | |
| 7,997,972 | B2 | 8/2011 | Nguyen et al. | |
| 8,209,221 | B2 | 6/2012 | Schwartz et al. | |
| 8,308,554 | B2 | 11/2012 | Rowe et al. | |
| 8,616,959 | B2 | 12/2013 | Iddings et al. | |
| 8,641,517 | B2 | 2/2014 | Bryant et al. | |
| 2002/0025843 | A1* | 2/2002 | Bryant | G07F 17/3244 463/16 |
| 2002/0077173 | A1* | 6/2002 | Luciano | G07F 17/32 463/25 |
| 2003/0036427 | A1 | 2/2003 | Brandstetter et al. | |
| 2003/0060256 | A1 | 3/2003 | Joshi | |
| 2004/0038736 | A1* | 2/2004 | Bryant | G07F 17/3244 463/29 |
| 2004/0192429 | A1 | 9/2004 | Moody | |
| 2006/0194631 | A1 | 8/2006 | Rowe et al. | |
| 2006/0252519 | A1* | 11/2006 | Walker | G07F 17/32 463/25 |
| 2009/0042634 | A1 | 2/2009 | Cannon et al. | |
| 2011/0319158 | A1 | 12/2011 | Champagne et al. | |
| 2012/0270640 | A1 | 10/2012 | Baerlocher et al. | |
| 2013/0012284 | A1 | 1/2013 | Bryant et al. | |
| 2013/0059648 | A1 | 3/2013 | Rowe et al. | |
| 2013/0065674 | A1* | 3/2013 | Luciano, Jr. | G07F 17/32 463/25 |

* cited by examiner

INCORPORATING A SECONDARY GAME WITH A LOYALTY PROGRAM

RELATED APPLICATIONS

This application claims the priority benefit of U.S. Provisional Application No. 61/822,202 filed May 10, 2013.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

TECHNICAL FIELD

Embodiments of the inventive subject matter relate generally to wagering game systems and networks that, more particularly, wagering-game, customer loyalty programs.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Wagering game providers and operators provide customer loyalty programs to reward patrons for using their products and services. For example, a casino may reward a patron for playing at their casino by offering a complimentary ("comp"). Comps are typically funded by the operator and include free games, free dining, free hotel stay, etc.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operations performed by some embodiments while the third section describes additional embodiments. A fourth section describes example operating environments. A fifth section presents some general comments.

INTRODUCTION

This section provides an introduction to some embodiments.

Wagering games are expanding in popularity. Many wagering game enthusiasts are demanding greater access to wagering games and content related to wagering games. As stated previously, some wagering game providers and operators provide customer loyalty programs to reward customers for use of their products and services. Some embodiments of the inventive subject matter include conducting a secondary game associated with one or more wagering games. For example, the secondary game can be a community game that tracks player activity at a group (e.g., a bank) of wagering game machines. Some embodiments further include incorporating the secondary game with the customer loyalty program to provide customer-loyalty rewards to players in direct response to activity (e.g., game outcomes) via the one or more wagering games.

Figure 1:
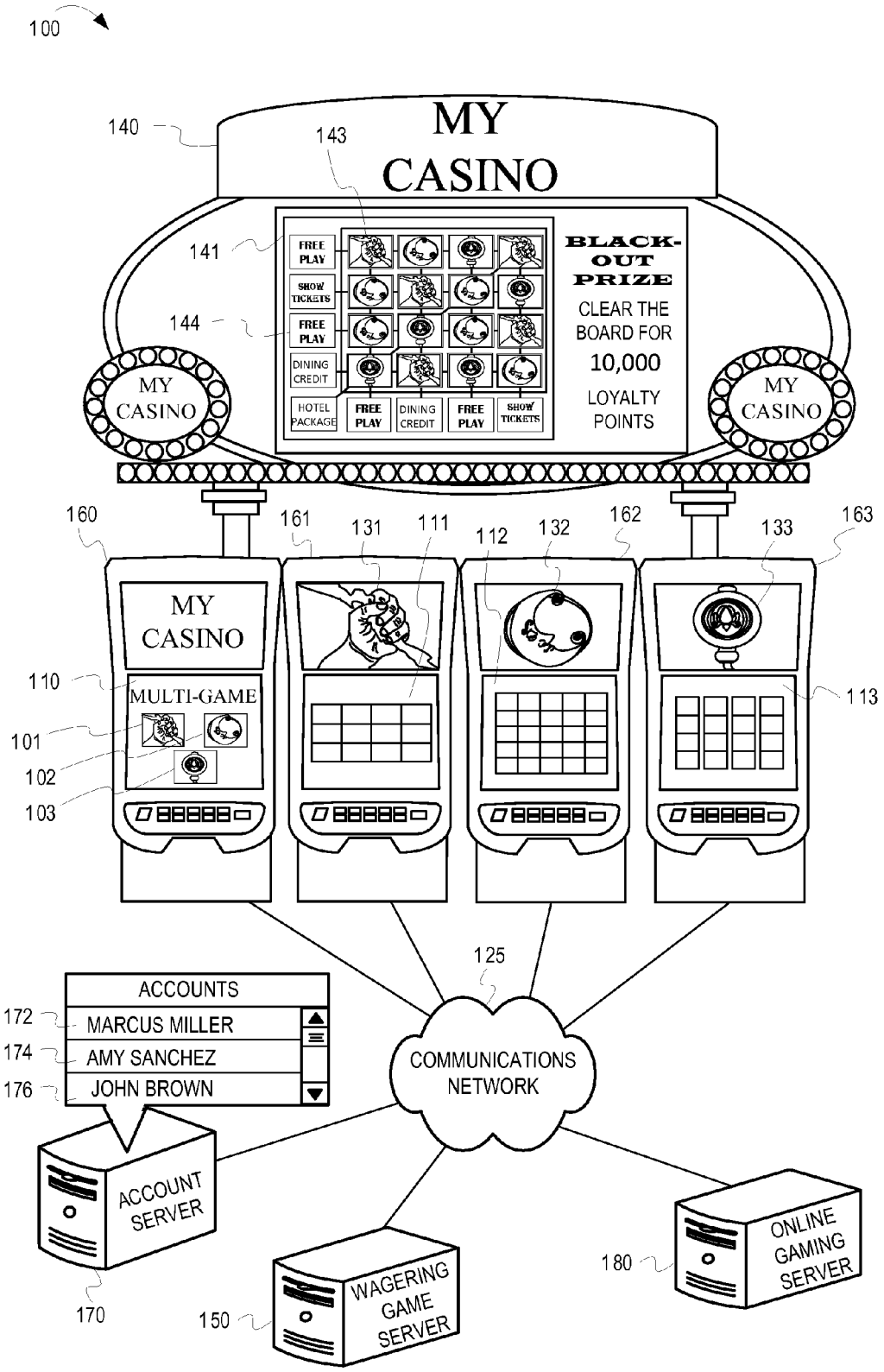
FIG. 1 is an illustration of incorporating a secondary game with a customer loyalty program, according to some embodiments.

FIG. 1 is a conceptual diagram that illustrates an example of incorporating a secondary game with a customer loyalty program, according to some embodiments. In FIG. 1, a wagering game system ("system") 100 includes a plurality of wagering game machines 160, 161, 162, and 163 ("wagering game machines 160-163"). The wagering game machines 160-163 are grouped together in a bank. The wagering game machines 160-163 can be linked together in a local network for coordinated presentations, gaming functionality, or other reasons. In some embodiments, the bank is grouped by game type, machine type, or some other commonality. For example, each of the wagering game machines 160-163 is a multi-game type of wagering game machine that provides options to select one of many different types of wagering games to play. Each of the wagering games can have a different theme from each other, different functionality, different game rules, etc. For instance, the wagering game machine 160 presents, via a display 110, a user interface for a player to select one of various graphics 101, 102, and 103. The same graphics 101, 102, and 103 can be presented via any one of the wagering game machines 161, 162, and 163. When a first of the graphics is selected, (e.g., graphic 101) a first wagering game (e.g., the "Zeus" game 111) is presented. Wagering game machine 161 presents the Zeus game 111. The Zeus game 111 may also be referred to as the first wagering game. When a second of the graphics is selected, (e.g., graphic 102) a second wagering game (e.g., the "Sea of Tranquility" game 112) is presented. Wagering game machine 162 presents the Sea of Tranquility game 112. The Sea of Tranquility game 112 may also be referred to as the second wagering game. When a third of the graphics is selected, (e.g., graphic 103) a third wagering game (e.g., the "Voyages of Sinbad" game 113) is presented. Wagering game machine 163 presents the Voyages of Sinbad game 113. The Voyages of Sinbad game 113 may also be referred to as the third wagering game.

The system 100 also includes a wagering game server 150 connected to the wagering game machines 160-163 via a communications network 125. The system 100 also includes an account server 170 and an online gaming server 180 connected via the communications network 125. Wagering game players that use the wagering game machines 160-163 can have wagering game player accounts (e.g., accounts 172, 174, and 176) stored on the account server 170. For example, a first player (e.g., Marcus Miller) uses a first account 172 to logon to the wagering game machine 161. The wagering game machine 161 uses the first account 172 to conduct a wagering game session for the first player. For example, the first account 172 includes an account balance of credits that the player can use in the wagering game session to transact wagers. The first account 172 is also associated with a customer loyalty program to track loyalty points for the first player. The customer loyalty program can include levels of status for the player to attain (e.g., silver, gold, diamond, etc.). The first player earns the points by performing certain wagering activities via the system 100. A customer loyalty program can provide prizes that are not part of a wagering game and/or that are different from prizes or awards that are offered via the wagering game. In some embodiments, the prizes can be monetary or non-monetary, such as cash prizes, event tickets, merchandise, goods, services, customer loyalty points, invitations, exclusive game content, coupons, accommodations, complimentary items, status enhancers, privileges, downloads, etc. In some instances, the prizes are not funded by wagers from the wagering game, and are instead funded by marketing funds. In some instances, the prizes for a customer loyalty program may be referred to as "customer-loyalty prizes," or "promotional prizes". Accounts 174 and 176 are similar to the account 172 and can be used in similar ways. In one example, a second player (e.g., "Amy Sanchez") uses the second account 174 to logon to the wagering game machine 162. A third player (e.g., John Brown) uses the third account 176 to logon to the wagering game machine 163.

In some embodiments, the wagering game server 150 controls a secondary game. The secondary game is different from any of the wagering games presented via any of the wagering game machines 160-163 (e.g., the secondary game has different rules, different outcomes, different objectives, different functionality, etc. than the wagering games). However, the secondary game uses information from the wagering games (e.g., game outcomes, achievements, scores, specific events, etc.) to complete game objectives for the secondary game. The secondary game can be associated with one or more of the wagering game machines 160-163. For example, the secondary game can be associated with only one of the wagering game machines 160-163 and can utilize information from any of the wagering games provided by the one of the wagering game machines 160-163. In other embodiments, however, such as that shown in FIG. 1, the secondary game is associated with a group game ("community game") that involves more than one of the wagering game machines 160-163 used by multiple players. Many of the examples described herein are related to a community game, however, it should be understood that a community game is only one type of secondary game. Other types of secondary game may include, but not be limited to, secondary wagering games, bonus games, social games, online games, etc.

One or more elements of the community game is presented for view by the participants of the community game. For example, a community game board ("game board") 141 is presented on signage 140. The signage 140 is presented within viewing distance of the wagering game machines 160-163 and is related to activity performed by the players via the wagering game machines 160-163. The game board 141 includes game spaces 143 and prize indicators 144. The game spaces 143 are directly related to activities performed via the wagering game machines 160-163. The game spaces 143 can have an appearance of logos for any of the wagering games offered via the wagering game machines 160-163. The game spaces 143 can be claimed, or attained, by the players by achieving accomplishments via the different wagering games presented on the wagering game machines 160-163. Each of the game spaces 143 on the game board 141 can represent a different achievement in the different wagering games. In some embodiments, the achievement is an outcome of the wagering game (e.g., a specific reel stop configuration, a specific card hand, etc.). The appearance of the game spaces 143 are visual indicators that a given game space is directly associated with a particular wagering game. For instance, a game space that looks like the logo 131 can only be attained in the community game by accomplishing an achievement from the Zeus game 111. Likewise, a game space that looks like the logo 132 can only be attained by accomplishing an achievement from the Sea of Tranquility game 112. Further, a game space that looks like the logo 133 can only be attained by accomplishing an achievement from the Voyages of Sinbad game 113.

In some embodiments, the system 100 detects when a player attains an achievement in one of the wagering games. In response to detecting the attainment of the achievement, the system 100 highlights an entry on the game board 141 associated with the achievement, and associates the achievement with the player who accomplished the achievement. The wagering game server 150 keeps track of the achievements and the game spaces 143 attained by the players.

When a game objective of the community game is completed, the system 100 provides one or more prizes to any of the players who have attained one or more of the game spaces 143 on the game board 141 associated with that game objective. The one or more prizes can be an award for the customer loyalty program. The system 100 can assign the one or more prizes to any of the player accounts 172, 174, and 176 associated with the any of the players who have attained the one or more of the game spaces 143. In other examples, the system 100 prints a ticket for a player, which ticket the player can redeem at a kiosk in the casino or at other locations associated with the prize. The game objective of the community game may include completing a specific pattern of the game spaces 143 on the game board 141, such as completing a row, a column, a diagonal, or some other geometric shape.

Although FIG. 1 describes some embodiments, the following sections describe many other features and embodiments.

Further, some embodiments of the inventive subject matter describe examples of incorporating a secondary game with a customer loyalty program in a network wagering venue (e.g., an online casino, a wagering game website, a wagering network, etc.) using a communication network, such as the communications network 125 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, for purposes of the present detailed description, a user may be referred to as a player (i.e., of wagering games), and a player may be referred to interchangeably as a wagering game player account, or player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Furthermore, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 2:
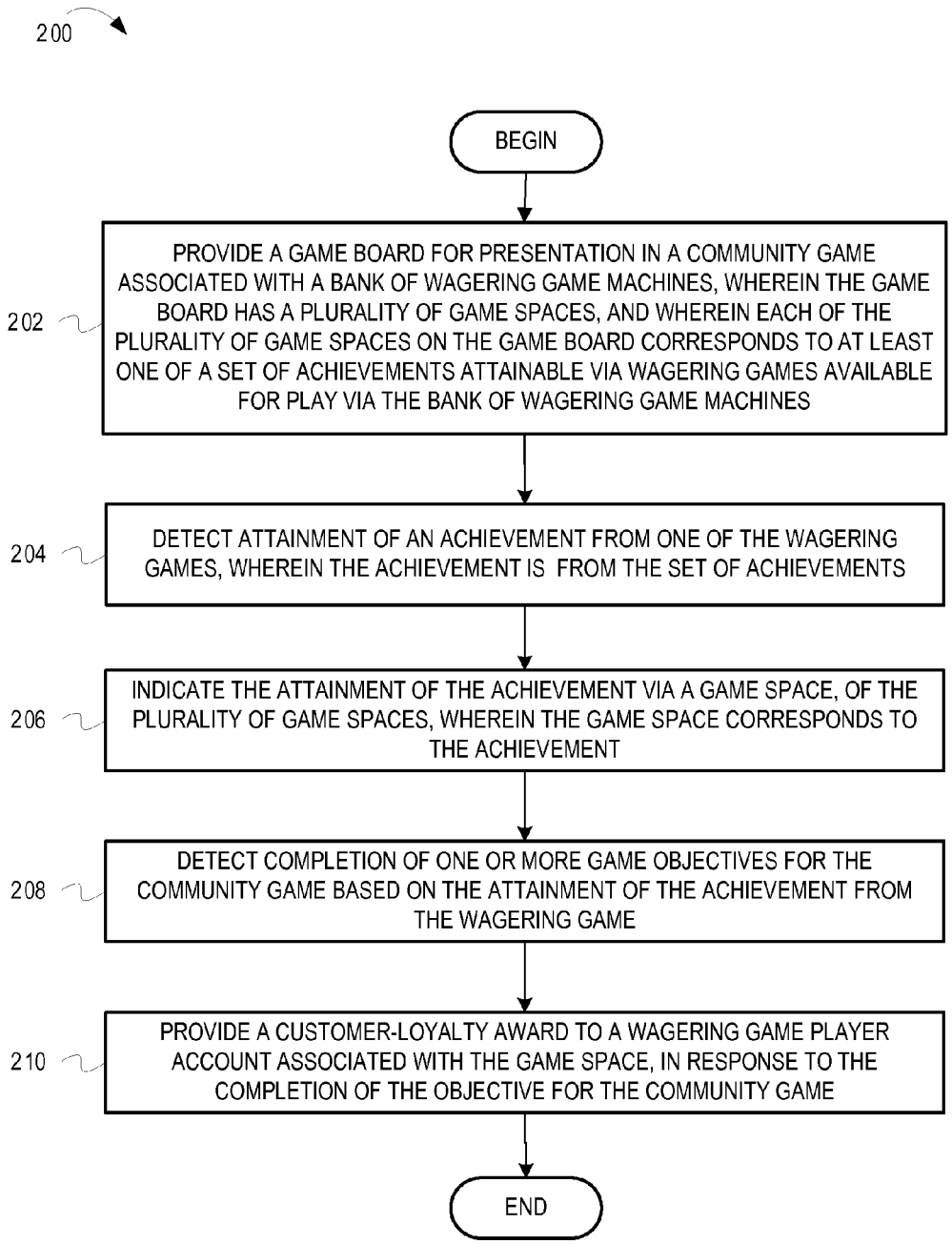
FIG. 2 is a flow diagram 200 illustrating providing customer-loyalty awards for attainment of community-game objectives associated with wagering game achievements, according to some embodiments.

FIG. 2 is a flow diagram ("flow") 200 illustrating providing customer-loyalty awards for attainment of community-game objectives associated with wagering game achievements, according to some embodiments. FIGS. 3 through 8 are conceptual diagrams that help illustrate the flow of FIG. 2, according to some embodiments. This description will present FIG. 2 in concert with FIGS. 3 through 8.

Figure 3:
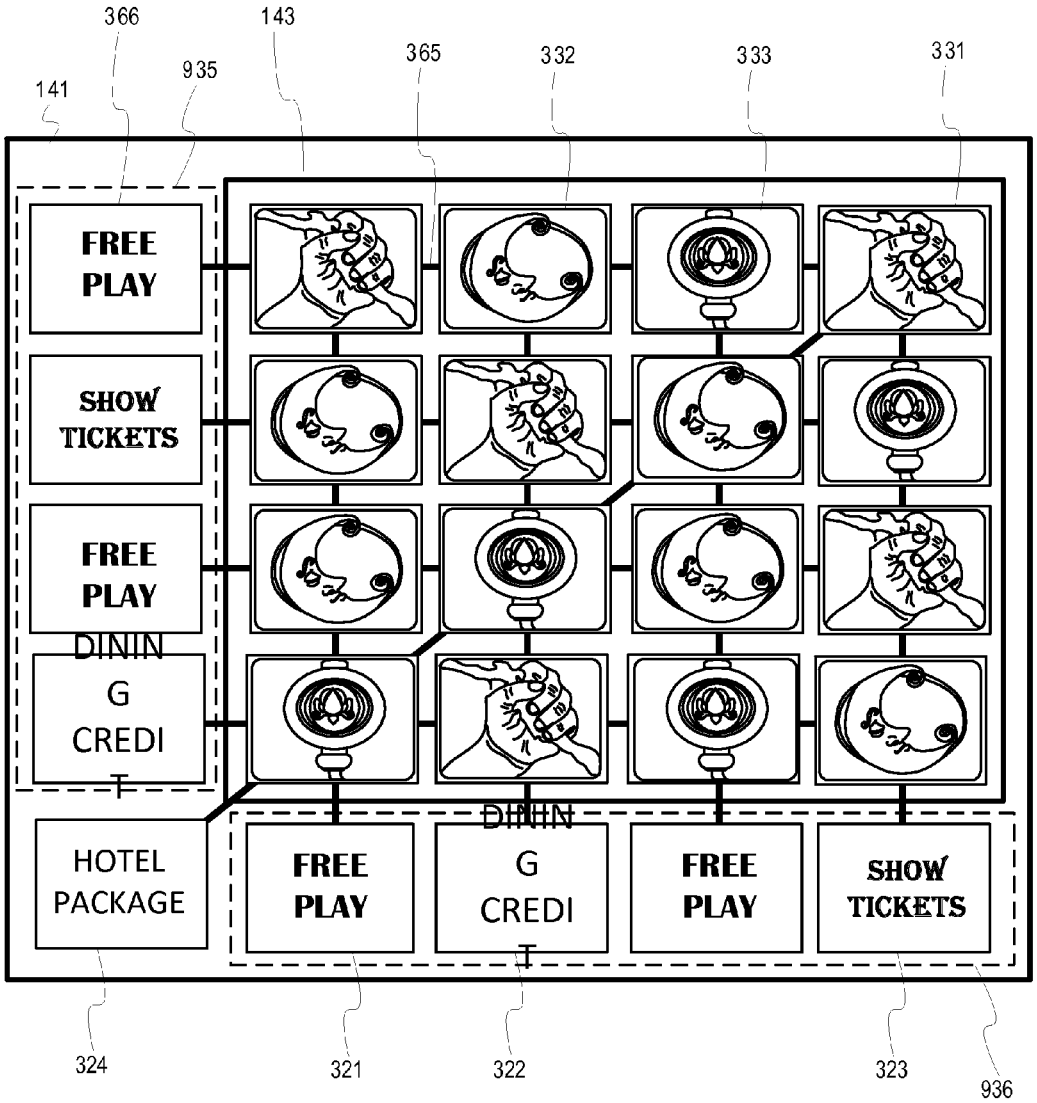
FIG. 3 is an illustration of a game board for a community game, according to some embodiments.
Figure 4:
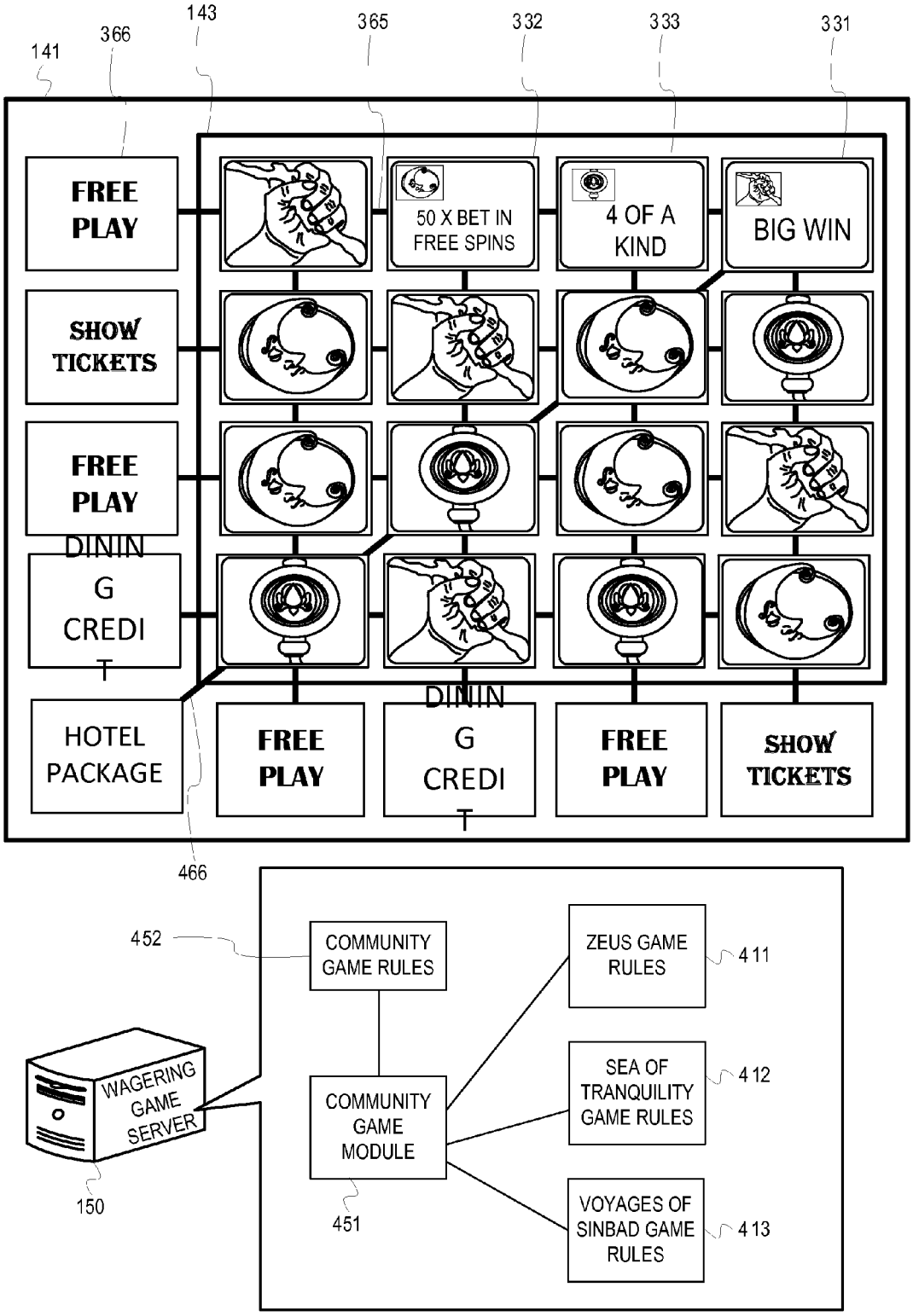
FIG. 4 is an illustration of associating wagering game achievements to game spaces on a game board, according to some embodiments.

In FIG. 2, the flow 200 begins at processing block 202, where a wagering game system ("system") provides a game board for presentation in a community game associated with a bank of wagering game machines. The game board has a plurality of game spaces, and each of the plurality of game spaces on the game board corresponds to at least one of a set of achievements attainable via wagering games. The wagering games are available for play via the bank of wagering game machines. In some embodiments, a plurality of wagering game player accounts, associated with the bank of wagering game machines, compete to attain the plurality of achievements in the community game. In some embodiments, at least some of the wagering games are different from each other (e.g., differently themed, different in functionality, different in content, different in type, different in rules, etc.). Thus, in some embodiments, at least one of the set of achievements that is attainable from a first wagering game, is not attainable from a second wagering game, and vice versa. In some examples, the game spaces have identifiers that uniquely identify differing ones of the plurality of wagering games (e.g., unique logos for the different wagering games, graphics of unique characters of the different wagering games, etc.). In some examples, each of the wagering game machines in the bank has "multi-game" functionality to permit a player to select any of the different wagering games related to game spaces on the game board. FIG. 1 illustrated one example of a game board 141. FIG. 3 illustrates the game board 141 in more detail. In FIG. 3, a first type of game space (e.g., game space 331) is associated with (e.g., has a substantially similar appearance to) the logo 131 for the first wagering game 111, a second type of game space (e.g., game space 332) is associated with the logo 132 for the second wagering game 112, and a third type of game space (e.g., game space 333) is associated with the logo 133 for the third wagering game 113.

The game board 141 includes prize indicators for one or more prizes of the community game. The prize indicators can be associated with different prizes. A first prize indicator 321 is associated with a first type of loyalty-program prize (e.g., an amount of "free play" of one or more wagering games). A second prize indicator 322 is associated with a second type of loyalty-program prize (e.g., an amount of "dining credits" for complimentary food or drinks). A third prize indicator 323 is associated with a third type of loyalty-program prize (e.g., a number of "show tickets," for a complimentary show, or form of entertainment available at a casino or other entertainment venue). A fourth prize indicator 324 is associated with a fourth type of loyalty-program prize (e.g., a "hotel package" that includes complimentary accommodation credits or discounts).

The prize indicators are associated with the one or more objectives for the community game. Objectives of the community game include completing, or filling in, more than one of the plurality of games spaces 143 in a specific geometric configuration, or pattern, on the game board 141.

For example, the game board 141 is a square-shaped array with a 4×4 matrix of the game spaces 143 aligned in rows and columns. Completion of a game objective may include completing a row, a column, and/or an diagonal, as well as a specific shape that may involve multiple vectors of the array (e.g., a "T" shape or cross, an "X" shape, an "L" shape, a square shape, a blackout, etc.). The game board 141 includes objective indicators to highlight game spaces that are connected into a specific pattern that would result in a win, or prize payout. For example, a row connector 365 connects game spaces in a top row of the game board 141 to prize indicator 366. The row connector 365 indicates that as soon as the game spaces in the top row are attained, then the top row is completed, and the prize associated with the prize indicator 366 can be awarded. The specific patterns that indicate a completion of a game objection may be referred to as a "payline pattern," a "payout pattern" or a "prize pattern" because the pattern, once completed, is associated with the payout of the one or more prizes. The objective indicators, such as the row connector 365, may be referred to as payout pattern indicators, or payline indicators. Each of the payout patterns can be associated with different prizes The system further associates each of the game spaces 143 with a different potential achievement from different wagering games. For example, in FIG. 4, the wagering game server 150 includes community game module 451 that accesses community game rules 452. The community game rules 452 include a rule set that specifies the objectives and functionality of the community game. The community game module 451 has access to game rules for the first wagering game (e.g., the Zeus game rules 411) which specify a first set of potential achievements that can occur in the first wagering game. The community game module 451 also has access to game rules for the second wagering game (e.g., the Sea of Tranquility game rules 412), which specify a second set of potential achievements that can occur in the second wagering game. The community game module 451 also has access to game rules for the third wagering game (e.g., the Voyages of Sinbad game rules 413), which specify a third set of potential achievements that can occur in the third wagering game. The first set of potential achievements, second set of potential achievements, and third set of potential achievements are all different from each other. For example, referring back to FIG. 1, the Zeus game 111 has four columns and three rows of game symbols. Therefore, for any given payline of the Zeus game 111, there can only be, at most, four of the same type of symbol arranged horizontally. Further, there can only be twelve symbols displayed at any given time. In contrast, the Sea of Tranquility game 112 has five columns and five rows of game symbols. Therefore, there can be up to five of the same type of symbol arranged horizontally on a payline and twenty-five symbols can be displayed. The Voyages of Sinbad game 113 has a four-by-four array of game symbols. Therefore, there can be only four of the same type of symbol arranged horizontally on a payline and sixteen symbols can be displayed. Each of the different games may also have different numbers of game symbols available for any given column (e.g., different numbers of reel symbols per reel, different numbers of winning reel-stop configurations, etc.). In some instances, depending on game rules, some symbols are unique and cannot be repeated more than one in any given game play (e.g., in a poker-type game there are 52 unique cards in a deck of 52 cards and only one given unique symbol can be displayed in any given round of play). Therefore, according to game mechanics, numbers of symbols, numbers of pay-table entries, numbers of potential winning outcomes, and odds for placement of given symbols on the game arrays for each individual game, each game can be uniquely different. Therefore, the potential achievements associated with each of the different wagering games are different.

The system can select from the rule sets and associate any of the game spaces 143 on the game board 141 with the particular achievements from the different wagering games. For instance, still referring to FIG. 4, for the game space 332, the system selects, from the Sea of Tranquility game rules 412, an achievement that indicates a winning outcome, during a bonus round for the Sea of Tranquility game 112, that equates to fifty times the bet that was made immediately prior to entering the bonus round. For the game space 333, the system selects, from the Voyages of Sinbad game rules 413, an achievement that indicates a wagering game outcome of any four of the same symbol arranged in a payline. For the game space 331, the system selects, from the Zeus game rules 411, an achievement that indicates a "big win" outcome, which, for the Zeus game 111, may require occurrence of a symbol configuration with very low odds of occurrence as well as a payout above a given threshold.

The system can select only specific ones of the achievements that meet threshold requirements (e.g., have odds of attainment above and/or below a given level). In some embodiments, the system can select, and associate, an achievement to a particular game space at a certain location of the game board 141 based on the odds of occurrence of the achievement and the advantageousness of the particular game space on the game board 141. For instance, if a game space is eligible to win multiple prizes in the community game, the system can assign an achievement with lower odds of occurrence to that game space. For example, the game space 331 may be a highly advantageous game space because, in some embodiments, and in given game conditions for the community game (e.g., see FIG. 8), the game space 331 it is eligible to potentially win up to three different prizes simultaneously. For instance, if the game space 331 is the last game space to be completed for the top row, the far right column, and the diagonal associated with objective indicator 466 ("the diagonal"), then the game space 331 can potentially win show tickets, a free play, and a hotel package. The same scenario is possible for any of the game spaces associated with the diagonal. Therefore, for the game space 331, the system selects an achievement from the Zeus game 111 that has lower odds of occurrence in the Zeus game 111 than other achievements, of the Zeus game 111, assigned to other game spaces that are not in the diagonal. In some embodiments, for game spaces in the diagonal associated with other games (e.g., the Sea of Tranquility game 112 and the Voyages of Sinbad game 113), the system can select achievements that have a similar odds of occurrence as the odds of occurrence of the achievement assigned to game space 331 associated with the Zeus game 111. In other embodiments, for game spaces in the diagonal associated with other games (e.g., the Sea of Tranquility game 112 and the Voyages of Sinbad game 113), the system can select achievements that have a similar relative odds of occurrence, relative to other achievements in the same game, as the relative odds of occurrence of the achievement assigned to game space 331, in the Zeus game 111, are to other achievements in the Zeus game 111.

In some embodiments, the system can select only achievements from games currently being played in the bank. For instance if the Zeus game 111, the Sea of Tranquility game 112, and the Voyages of Sinbad game 113 are the only games being played at the bank of wagering game machines 160-163, at the start of the community game, then the system may select only achievements from only those three games to include on the game board 141.

In other embodiments, however, the system can select achievements for all possible games available in the bank. For instance, if in addition to the Zeus game 111, the Sea of Tranquility game 112, and the Voyages of Sinbad game 113, there are other games available for play (e.g., via a "multi-play" feature of the wagering game machines 160-163), then the system may select other achievements from the other games to assign to the game board 141 even if those other games are not being played at the start of the community game. To attain those achievements, a game player playing one of the Zeus game 111, the Sea of Tranquility game 112, and/or the Voyages of Sinbad game 113, would have to log out of the Zeus game 111, the Sea of Tranquility game 112, and/or the Voyages of Sinbad game 113, and login to one of the other games for which a game space has been assigned on the game board 141.

In some embodiments, an online game can be incorporated into the community game. For example, in some embodiments, the online game can be a non-cash wagering game presented via the online gaming server 180 mentioned in FIG. 1. The system can access game rules from the online game server to incorporate achievements from the online game. The system can also provide non-monetary prizes for attainment of achievements in non-cash wagering games, or for non-wagering games.

Figure 5:
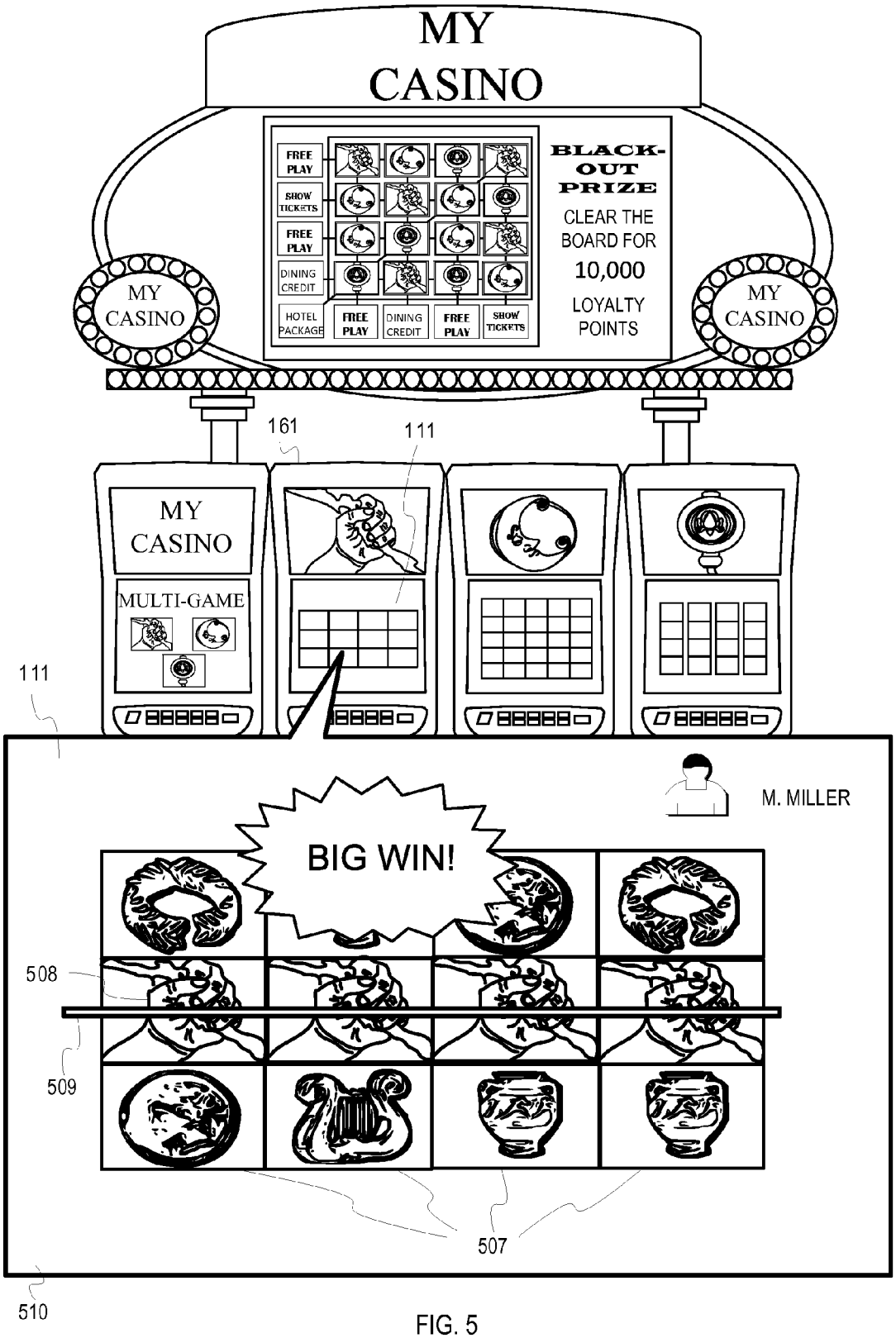
FIG. 5 is an illustration of detecting attainment of a wagering game achievement, according to some embodiments.
Figure 6:
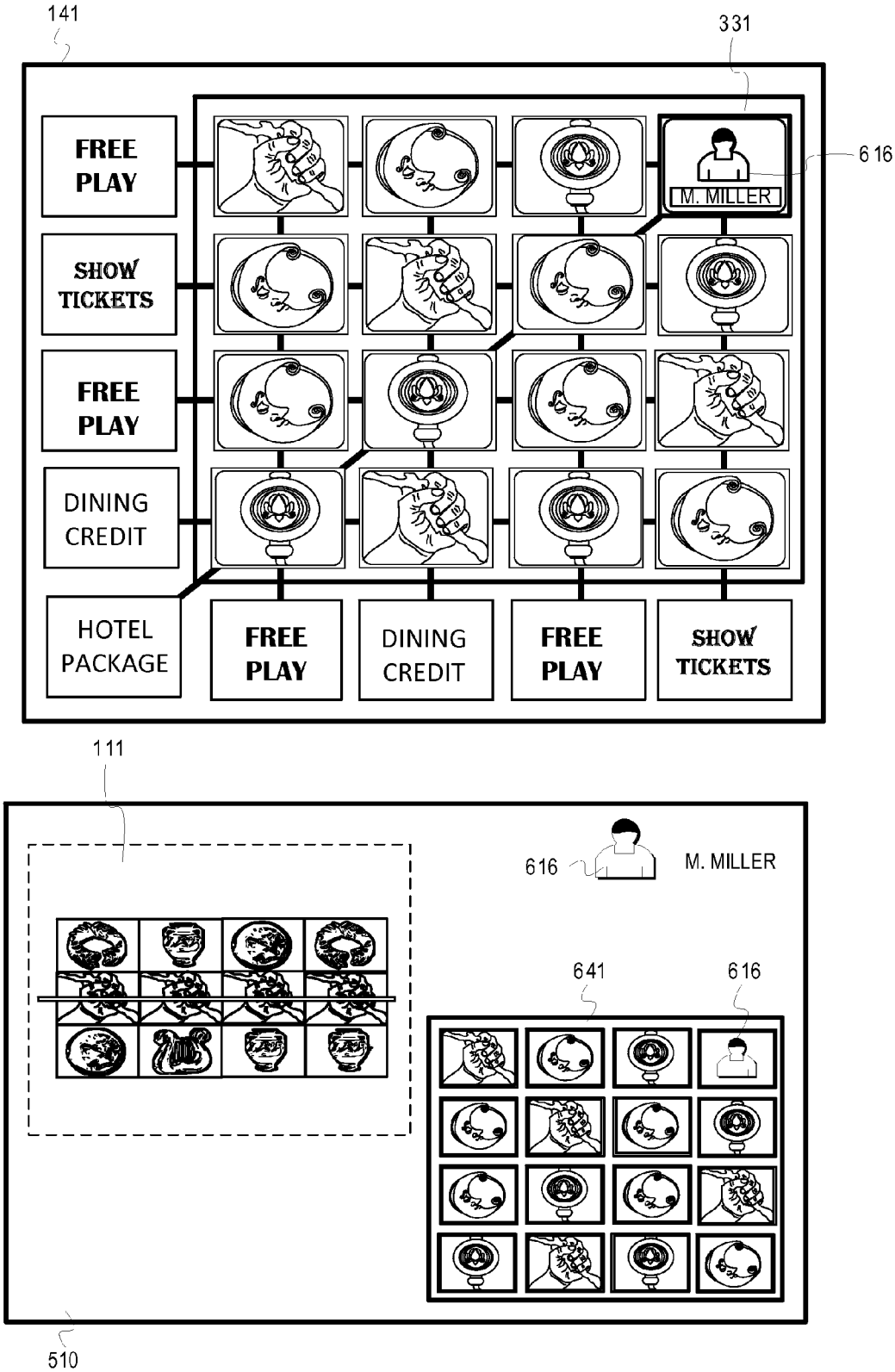
FIG. 6 is an illustration of assigning a game space on a game board in response to attainment of a wagering-game achievement, according to some embodiments.

Referring back to FIG. 2, the flow 200 continues at processing block 204, where the system detects attainment of an achievement from one of the wagering games. For example, as illustrated in FIG. 5, a player initiates a playing round for the Zeus game 111 by initiating a spin operation for reels 507 presented via a display 510 of the wagering game machine 161. For example, the player sets a desired wager amount per payline and a number of desired paylines, and then presses a "spin" button. In response to the spin operation, the system transacts a wager based on the wager amount per payline and the number of desired payline. The system generates a random number and arranges symbols on the reels 507 according to the random number. In FIG. 5, when the reels 507 stop spinning, a winning outcome is revealed that qualifies as the "big win" achievement indicated in FIG. 4 for the game space 331 (e.g., four of the reel symbols 508 align horizontally along a central payline 509).

Returning momentarily to FIG. 2, the flow 200 continues at processing block 206, where the system indicates the attainment of the achievement via a game space, of the plurality of game spaces. The game space corresponds to the achievement attained. For example, in FIG. 6, after the "big win" outcome occurs in the Zeus game 111, the system selects and highlights the game space 331. In some embodiments, the system removes the logo that was on the game space 331 and replaces it with a completion indicator (e.g., a blank image, a shaded image, a marked-out image, etc.). In some embodiments, the system presents a completion indicator that identifies a player. For example, in FIG. 6, the system indicates a personal identifier (e.g., avatar 616) of the player named Marcus Miller, who logged into the wagering game machine 161 and accomplished the achievement associated with the game space 331. The avatar 616 is only one way to identify a player. Other embodiments may include other unique graphical, numerical, textual, etc. identifiers associated with the player. The system also presents a secondary game board 641 game on the display 510 to indicate progress in the community game that is specific to the game player (e.g., specific to Marcus Miller). The system can minimize a view of the Zeus game 111 on the display 510 to show the secondary game board 641 (e.g., in response to an event in the community game and/or when the secondary game board 641 is selected by the player). Shortly after presenting the avatar 616 on the game space 331, the system may remove the appearance of the avatar 616 from the game board 141, leaving a blank space, or some completion indicator other than the avatar 616, to show that the achievement was completed and that the game space was claimed by the player. However, because the secondary game board 641 is player specific, the system leaves the instance of the avatar 616 on the secondary game board 641 as a persistent marker that identifies that the game space 331 is claimed, or earned, by the player. In some embodiments, no other player can attain the game space 331 for the duration of the community game. In some embodiments, the system can make suggestions to a player regarding what games to play given any remaining number of unattained game spaces left on the game board 141.

Returning momentarily to FIG. 2, the flow 200 continues at processing block 208, where the system detects completion of one or more game objectives for the community game based on the attainment of the achievement from the wagering game. For example, in FIG. 7, the system detects an achievement, via the Zeus game 111, which corresponds to game space 717 (e.g., four game symbols 708 arrange in a payline 709). The system, therefore, assigns the game space 717 to the player. The attainment of the game space 717 completes the far-right column 794 (i.e., game spaces 331, 716, and 718 had previously been attained in the community game). A game objective for the community game may be to complete a row, column, or diagonal, which then triggers an award of a prize associated with the row, column, or diagonal.

Returning momentarily to FIG. 2, the flow 200 continues at processing block 210, where the system provides a customer-loyalty award to a wagering game player account associated with the game space, in response to the completion of the objective for the community game. For example, when a payout pattern is completed on the game board, the system awards the prize, or prizes, associated with a payout pattern. The prize, or prizes, can be awarded to any, or all, player accounts that have a game space in the payout pattern. As described previously, the prizes can be sponsored by the casino and, therefore, do not need to be tied directly into the math of the game.

In one example, the system awards a prize to only the player account that completes the last remaining game space needed to complete the payout pattern.

In one example, when the payout pattern is completed, the system awards a prize to each player account that possesses a game space in the payout pattern.

In one example, when the payout pattern is completed, the system awards to a player account a number of the prizes associated with the payout pattern proportional to a number of game spaces that the player account possesses in the payout pattern.

Figure 7:
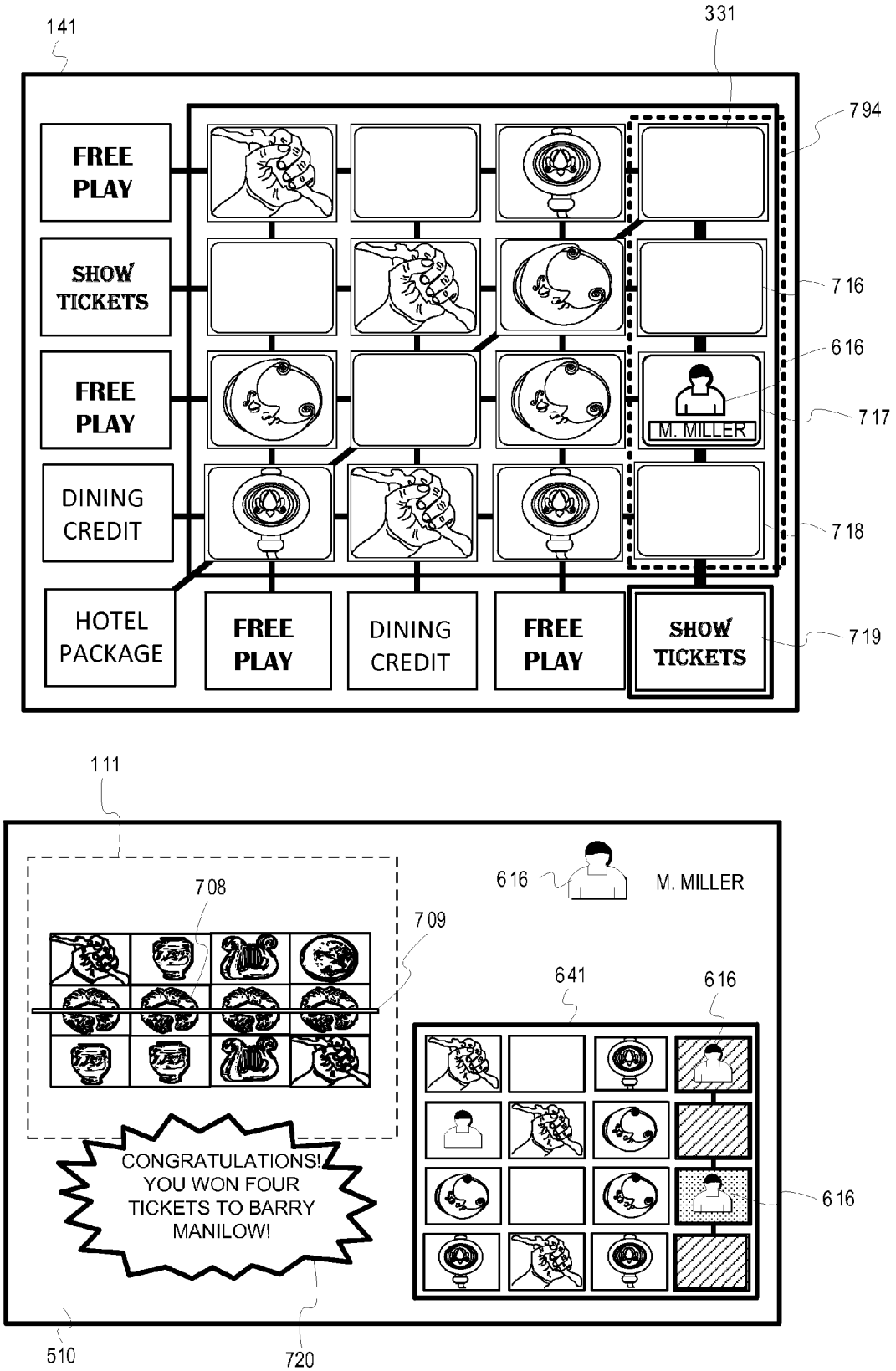
FIG. 7 is an illustration of providing a customer-loyalty award for completion of a community-game objective, according to some embodiments.

In FIG. 7, for example, with the attainment of the game space 717, the far-right column 794 is completed, and the prize associated with prize indicator 719 is awarded to the player. In some embodiments, the prize is also awarded to any other player that has attained any of the other game spaces 331, 716, and 718 in the far-right column 794. In some embodiments, the prize associated with the prize indicator 719 includes two tickets to a specific show. The secondary game board 641 shows that, in the far-right column 794, the player has attained two game spaces (e.g., marked by the avatar 616). Therefore, in some embodiments, the system provides double the prize (e.g., as indicated in the congratulatory message 720, the system provides four tickets to the specific show, instead of only two tickets). The system can store an electronic indicator of the prize in the player's wagering game player account. For example, the system can store a redeemable electronic coupon with a unique identifier (e.g., a barcode) for the tickets, which the player can print out later (e.g., via a personal computer) and present at the entertainment venue. The system can also print out a physical, redeemable form of the prize, such as a paper coupon printed from a wagering game machine. The player can take the paper coupon to a kiosk at the casino to obtain the tickets.

Further, when the prize is awarded during the community game, the system highlights the entire far-right column 794 to indicate that that particular game objective has been completed for the community game. For instance, the system makes the far-right column 794 look shaded or dimmed in the secondary game board 641 to indicate that the prize, or prizes, have been awarded for the far-right column 794. The system also makes the far-right column 794 on the game board 141 to appear completed. For example, after the system presents the avatar 616 in the game space 717, the system causes the game space 717, to appear blank, as for the other game spaces, 331, 716, and 718 in the far-right column 794. The system also causes the prize indicator 719 to appear completed (e.g., after awarding the show ticket, the system causes the prize indicator 719 to appear blank).

Figure 8:
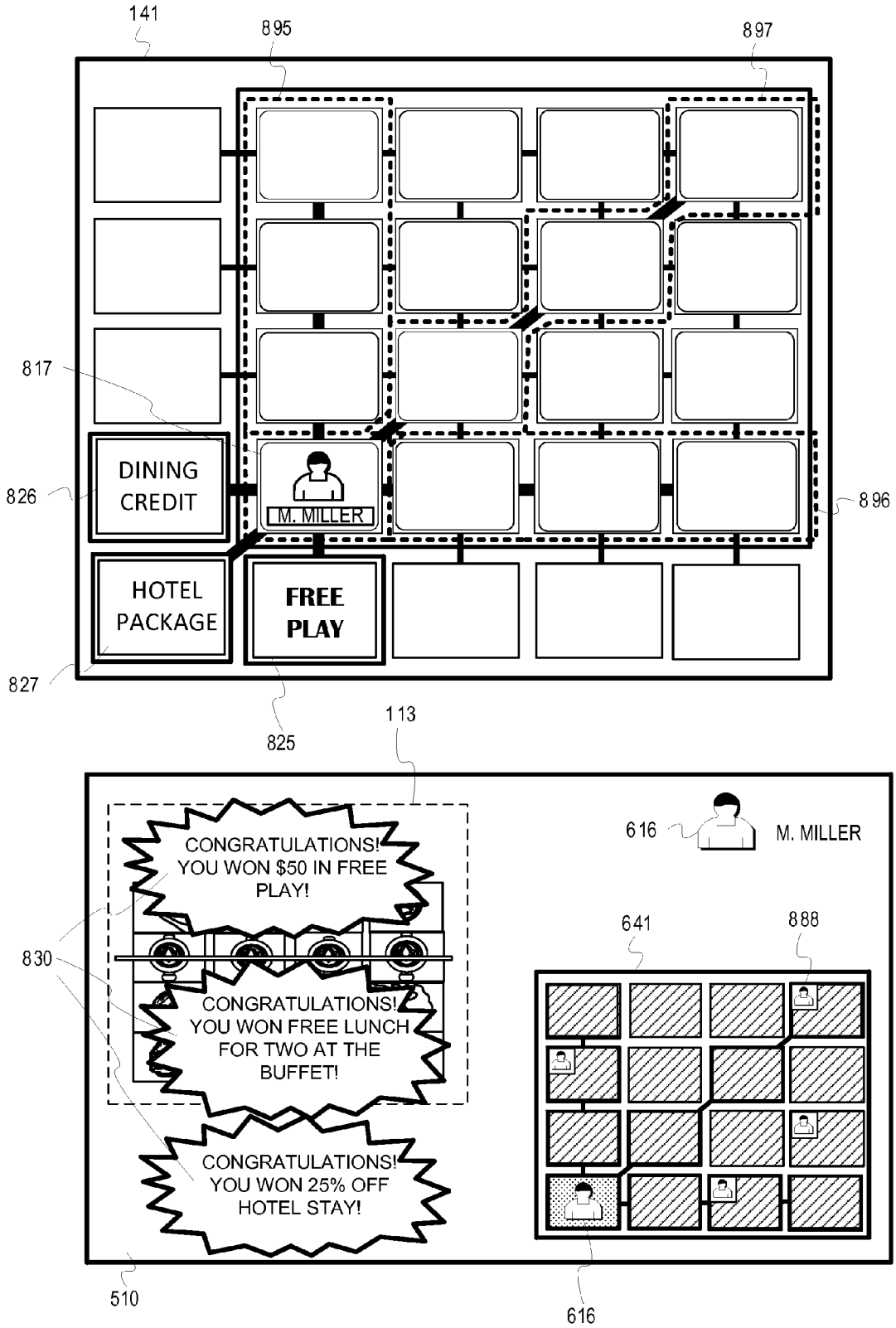
FIG. 8 is an illustration of providing multiple customer-loyalty awards for simultaneous completion of multiple community-game objectives, according to some embodiments.

In some examples, the system can detect simultaneous completion of multiple objectives for the community game and, in response, award multiple prizes. For example, the system can award multiple prizes when multiple payout patterns are simultaneously completed by the attainment of one game space. In FIG. 8, for example, a game space 817 is a final game space on the game board 141. The game space 817 is at an intersection of column 895, row 896, and diagonal 897. The player, who was previously playing the Zeus game 111 via wagering game machine 161 has, in this example, switched to playing the Voyages of Sinbad game 113 via the wagering game machine 161 and, therefore, the Voyages of Sinbad game 113 is now presented via the display 510. During play of the Voyages of Sinbad game 113, the player attains an achievement in that game that matches the achievement assigned to the game space 817. Therefore, the system assigns the game space 817 to the player, or, in other words, the player attains the game space 817. The attainment of the game space 817 causes simultaneous completion of the column 895, the row 896, and the diagonal 897. Column 895 is associated with prize indicator 825, row 896 is associated with prize indicator 826, and diagonal 897 is associated with prize indicator 827. The game spaces in the diagonal 897 have a chance of winning three prizes. Therefore, as mentioned previously, the achievements associated with the diagonal 897 have lower odds of completion (i.e., are less likely to occur and therefore harder to attain) in the corresponding wagering games than achievements assigned to other games spaces that are not in the diagonal 897. Upon simultaneous completion of the column 895, the row 896, and the diagonal 897, the system awards the player the three prizes associated with the prize indicator 825, the prize indicator 826, and the prize indicator 827.

The system indicates the three prizes via congratulatory messages 830. Further, the system indicates completion of the game space 817 by presentation of the avatar 616 in a corresponding game space on the secondary game board 641. The system also shows attainment indicators 888 of game spaces that were previously attained and/or awarded in the community game. Upon completion of the final game space 817, the game can provide a top prize, or grand prize, (e.g., 10,000 loyalty points) to the player who attained the final game space 817. In other embodiments, when the final game space 817 is completed, the system can distribute some portion of the grand prize, or provide additional prizes, proportional to a number of game spaces that each of the players attained during the community game. For example, the system can detect the number of attainment indicators 888 for the player and award additional loyalty points or other loyalty program awards. When the game board 141 is completed, the system can reset the game board 141 and restart the community game.

Additional Example Embodiments

According to some embodiments, a wagering game system ("system") can provide various example devices, operations, etc., incorporate a secondary game with a loyalty program. The following non-exhaustive list enumerates some possible embodiments.

Persisting Community Game Progress in a Player Account.

In some examples, the system can award a prize, or portion of a prize, to a player in a community game when the player is not currently playing at a bank of wagering game machines associated with the community game. For example, a player may have attained a game space in a payout pattern before the payout pattern is completed. The player may log out of the wagering game machine before the payout pattern is completed. If the player has a player account, then the system stores in the player's account an indication of the attainment of the game space. In other words, the system causes progress that the player has made in the community game to persist in the player's account. Later, another player who is playing at the bank may attain an achievement that completes the payout pattern. If the game rules are such that all players who had attained a game space received a prize, or portion of the prize, associated with the payout pattern, then the system can store in the player account an indication of the prize, or portion of the prize. The system can notify the player via email, mobile device, etc.

Setting Conditions for Completion of Community Game Objectives.

In some embodiments, the system can set various conditions for completion of community game objectives and/or payout patterns other than, or in addition to, attainment of game outcomes. For example, the system may set social conditions, time or date based conditions, spending requirements, etc. For instance, the system can require that more than one player complete game spaces in the payout pattern. In another example, the system requires that multiple players complete separate achievements from different wagering games before a payout pattern can be completed. In another example, the system can require completion of a game objective within a given time period.

Setting a Value of Loyalty Program Prizes Based on Player Status.

Figure 9:
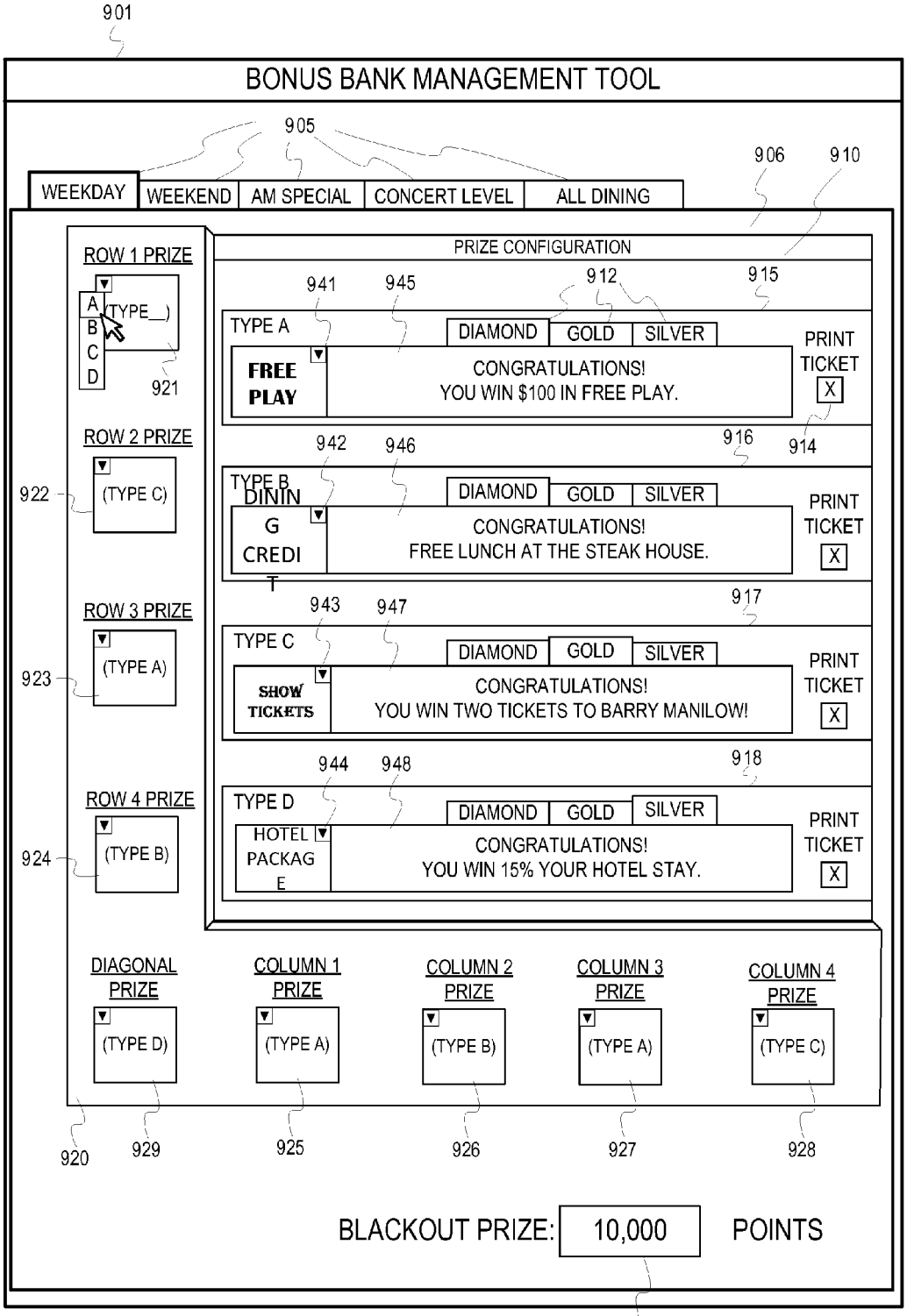
FIG. 9 is an illustration of configuration of a community game associated with a customer loyalty program, according to some embodiments.

In some embodiments, the system can modify a value of a prize awarded in the community game based on a status of a player in the loyalty program. For example, the system can provide a configuration tool to specify different levels of prize values to correspond with different levels of status. FIG. 9 illustrates an example of a configuration tool. In FIG. 9, a configuration tool interface ("interface") 901 is displayed that presents various features to configure prizes for a community game. The interface 901 includes first tabs 905 which can be selected to configure prizes for specific times, dates, events, themes, etc. When one of the tabs 905 is selected, a prize configuration panel 906 is displayed. The panel 906 is divided into two sections.

A first section 910 of the prize configuration panel 906 includes prize-type control panels 915, 916, 917, and 918 ("prize-type control panels 915-918"). The prize-type control panels 915-918 are used to configure information about types of prizes offered in the community game. For instance, a first type "A" relates to prizes available for play of wagering games, such as free plays, access to exclusive gaming content, etc. A second type "B" relates to prizes for food and drinks, such as free or discounted meals, drinks, and so forth. A third type "C" relates to prizes for entertainment, such as free or discounted show tickets, concert tickets, movie tickets, etc. A fourth type "D" relates to prizes for accommodations and travel, such as free or discounted hotel stay, airfare, taxi services, etc.

Indicator-appearance controls 941, 942, 943, and 944 ("indicator-appearance controls 941-944") can be used to configure an appearance, or image, of prize indicators used in the community game to indicate specific prizes. For example, in the prize-type control panel 915, an operator can select the first indicator-appearance control 941 to upload a graphical image (e.g., a custom graphic branded to the operator) to appear as the type of prize indicator associated with type "A" prizes (e.g., prize indicator 366 or 321 of FIG. 3 which have the phrase "Free Play" on them). In another example, the operator can select the first indicator-appearance control 941 to enter text, upload videos, flash files, or any other media associated with prize indicators.

The prize-type control panels 915-918 also include prize-description boxes 945, 946, 947, and 948 ("prize-description boxes 945-948"). For example, a first prize-description box 945 includes a description of the prize, such as a prize amount, a congratulatory message, etc.

The prize-type control panels 915-918 also include tabs 912 to select a specific player status level. In a customer loyalty program, players attain customer loyalty points at different rates based on their use of products and services. As a player's points increase, their loyalty status increases to indicate a level of loyalty. When any of the tabs 912 are selected, an operator can enter a different description of the prize, prize amount, etc. customized to the status level. For instance, at "Diamond" level, the prize-description box 945 reads "Congratulations! You win $100 in free play." At a lower level, such as "Gold" level, the prize description box 945 could be configured to read "Congratulations! You win $50 in free play." The amount of free play differs. Thus, if a first player with a customer loyalty status at Gold level attains a type "A" prize in the community game (e.g., a "Free Play" prize), then the system presents the congratulatory message "Congratulations! You win $50 in free play." The system awards the first player $50 in free play of wagering games. On the other hand, if a second player with a customer loyalty status at Diamond level attains a type "A" prize in the same community game, then the system presents the congratulatory message "Congratulations! You win $100 in free play." The system awards the player $100 in free play of wagering games. In some embodiments, the prize-type control panels 915-918 can have more than three tabs regarding customer loyalty status levels. In some embodiments, the system can automatically determine an amount of the free play to award (e.g., the system automatically awards an amount of free play proportional to status levels without requiring the operator to specify the amount in the prize-description boxes 945-948).

The prize-type control panels 915-918 also include a print control 914 configured to specify whether to physically print a ticket at the wagering game machine to indicate the prize.

A second, "L"-shaped section 920 includes indicator-placement controls 921, 922, 923, 924, 925, 926, 927, 928, and 929 ("indicator-placement controls 921-929"). The indicator-placement controls 921-929 correspond to the type of prizes from the first section 910. For example, a portion of the indicator-placement control 921 is selected to set a type of prize (e.g., type "A," "B," "C," or "D"). When a type is specified for the indicator-placement control 921, the system links the indicator-placement control 921 to a corresponding one of the prize-type control panels 915-918. For example, if type "A" is selected via the indicator-placement control 921, then the indicator-placement control 921 is linked to the prize-type control panel 915. The indicator-placement control 921 inherits the properties of the prize-type control panel 915. For instance, a prize indicator associated with the prize-type control panel 915 will appear, on a game board, as a "Free Play" graphic selected via use of the indicator-appearance control 941.

Furthermore, the indicator-placement controls 921-929 are positioned in the second section 920 relative to positions at which prize indicators will subsequently be presented on a game board during a community game. For instance, in FIG. 3, when a community game begins, and the game board 141 is presented, the system uses the positions of the four indicator-placement controls 921, 922, 923, and 924 (FIG. 9) to position, in relative locations, the four prize indicators 935 (FIG. 3) on the game board 141. The system uses the positions of the four indicator-placement controls 925, 926, 927, and 928 (FIG. 9) to position, in relative locations, the prize indicators 936 (FIG. 3) on the game board 141. Finally, the system uses the position of the indicator-placement control 929 (FIG. 9) to position, in a relative location, the prize indicator 324 (FIG. 3) on the game board 141.

The prize configuration panel 906 also includes a grand prize control 955 to specify a grand prize for the community game.

Regarding the tabs 905, some of the tabs 905 indicate specific dates and/or times at which the system can automatically transition from a first configuration setting to a second, different configuration setting. For example, at 12 AM on Friday evening, the system can transition prizes available for community games from "Weekday" settings to "Weekend" settings. The "Weekend" settings may have higher prize values than those of "Weekday" settings. In some embodiments, if a community game at a particular bank, using the first configuration settings, has already assigned some game spaces to some players, but has not completed all game objectives at the time for automatic transition to the second configuration setting, the system can wait until all game objectives are completed for the community game before transitioning to the second configuration setting. For example, the system can wait until the game board 141 is cleared. In other embodiments, if the community game has already assigned some game spaces to some players, but has not completed all game objectives at the time for automatic transition to the second configuration setting, the system can automatically change prize values to match those of the second configuration settings as long as the prize values are higher and not lower in value than those indicated by the first configuration settings. In some embodiments, the system can maintain some prize values only for the player or players who have obtained game spaces prior to the transition.

Example Operating Environments

This section describes example operating environments, systems, networks, etc. and presents structural aspects of some embodiments.

Figure 10:
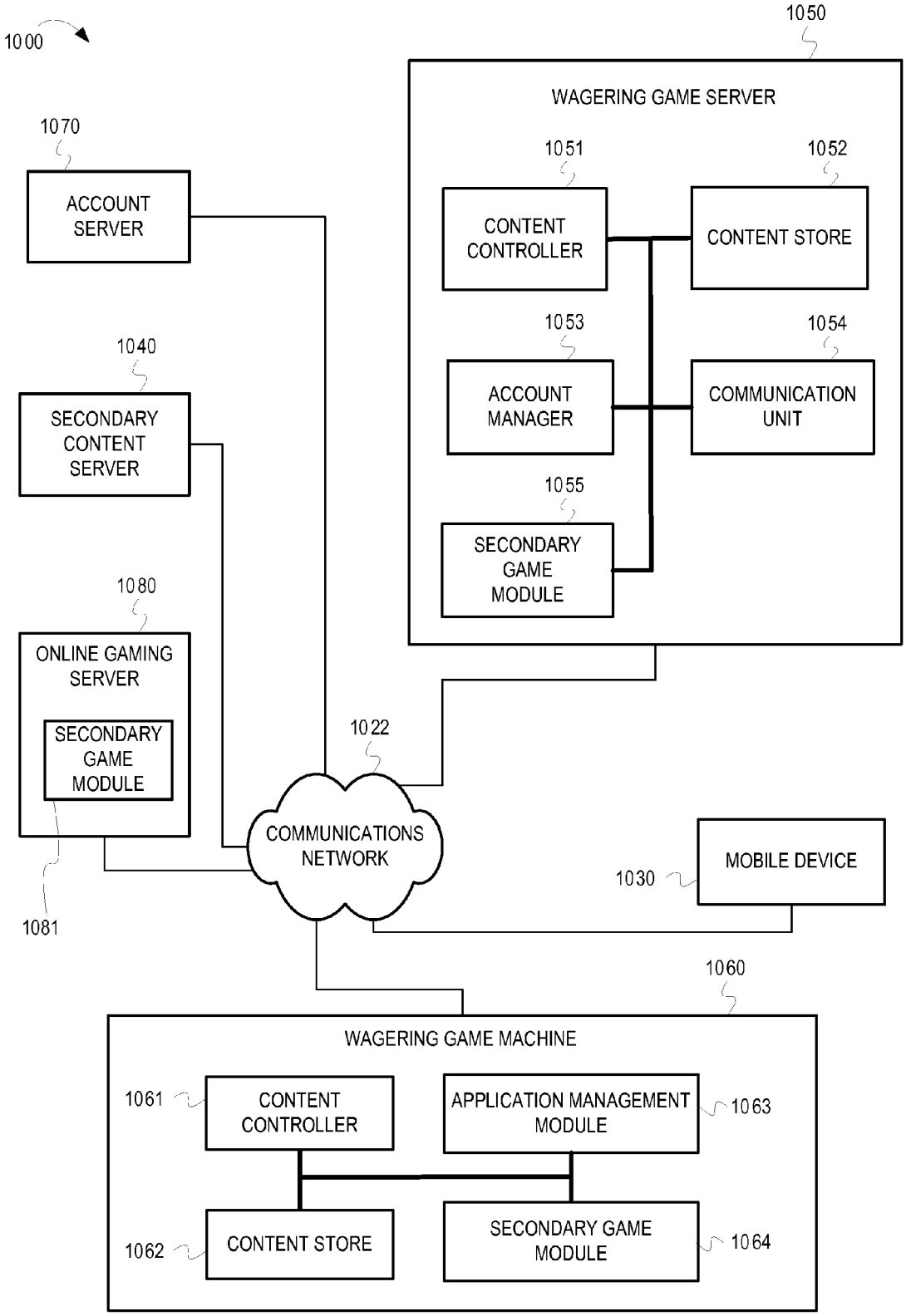
FIG. 10 is an illustration of a wagering game system architecture 1000, according to some embodiments.

FIG. 10 is a conceptual diagram that illustrates an example of a wagering game system architecture 1000, according to some embodiments. The wagering game system architecture 1000 can include an account server 1070 configured to control user related accounts accessible via wagering game networks and social networking networks. The account server 1070 can store wagering game player account information, such as account settings (e.g., settings related to group games, etc., settings related to social contacts, etc.), preferences (e.g., player preferences regarding content presentable via an application of a mobile device, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 1070 can contain lists of social contacts referenced by a player account. The account server 1070 can also provide auditing capabilities, according to regulatory rules. The account server 1070 can also track performance of players, machines, and servers. The account server 1070 can also track customer loyalty points, status information, etc. associated with a customer loyalty program.

The wagering game system architecture 1000 can also include a wagering game server 1050 configured to control wagering game content, provide random numbers, and communicate wagering game information, account information, and other information to and from a wagering game machine 1060. The wagering game server 1050 can include a content controller 1051 configured to manage and control content for presentation on the wagering game machine 1060. For example, the content controller 1051 can generate game results (e.g., win/loss values), including win amounts, for games played on the wagering game machine 1060. The content controller 1051 can communicate the game results to the wagering game machine 1060. The content controller 1051 can also generate random numbers and provide them to the wagering game machine 1060 so that the wagering game machine 1060 can generate game results. The wagering game server 1050 can also include a content store 1052 configured to contain content to present on the wagering game machine 1060. The wagering game server 1050 can also include an account manager 1053 configured to control information related to player accounts. For example, the account manager 1053 can communicate wager amounts, game results amounts (e.g., win amounts), bonus game amounts, etc., to the account server 1070. The wagering game server 1050 can also include a communication unit 1054 configured to communicate information to the wagering game machine 1060 and to communicate with other systems, devices and networks. The wagering game server 1050 can also include a secondary game module 1055 configured to incorporate a secondary game with a customer loyalty program.

The wagering game system architecture 1000 can also include the wagering game machine 1060 configured to present wagering games. The wagering game machine 1060 can include a content controller 1061 configured to manage and control content and presentation of content on the wagering game machine 1060. The wagering game machine 1060 can also include a content store 1062 configured to contain content to present on the wagering game machine 1060. The wagering game machine 1060 can also include an application management module 1063 configured to manage multiple instances of gaming applications. For example, the application management module 1063 can be configured to launch, load, unload and control applications and instances of applications. The application management module 1063 can launch different software players (e.g., a Microsoft® Silverlight™ player, an Adobe® Flash® player, etc.) and manage, coordinate, and prioritize what the software players do. The application management module 1063 can also coordinate instances of server applications in addition to local copies of applications. The application management module 1063 can control window locations on a wagering game screen or display for the multiple gaming applications. In some embodiments, the application management module 1063 can manage window locations on multiple displays including displays on devices associated with and/or external to the wagering game machine 1060 (e.g., a top display and a bottom display on the wagering game machine 1060, a peripheral device connected to the wagering game machine 1060, a mobile device connected to the wagering game machine 1060, etc.). The application management module 1063 can manage priority or precedence of client applications that compete for the same display area. For instance, the application management module 1063 can determine each client application's precedence. The precedence may be static (i.e. set only when the client application first launches or connects) or dynamic. The applications may provide precedence values to the application management module 1063, which the application management module 1063 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 1063 of its current presentation state. The applications may provide presentation state values to the application management module 1063, which the application management module 1063 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 1063 can be pre-configurable. The system can provide controls and interfaces for operators to control screen layouts and other presentation features for the configuring of the application management module 1063. The application management module 1063 can communicate with, and/or be a communication mechanism for, a base game stored on a wagering game machine. For example, the application management module 1063 can communicate events from the base game such as the base game state, pay line status, bet amount status, etc. The application management module 1063 can also provide events that assist and/or restrict the base game, such as providing bet amounts from secondary gaming applications, inhibiting play based on gaming event priority, etc. The application management module 1063 can also communicate some (or all) financial information between the base game and other applications including amounts wagered, amounts won, base game outcomes, etc. The application management module 1063 can also communicate pay table information such as possible outcomes, bonus frequency, etc. In some embodiments, the application management module 1063 can control different types of applications. For example, the application management module 1063 can perform rendering operations for presenting applications of varying platforms, formats, environments, programming languages, etc. For example, the application management module 1063 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 1063 can include a portable virtual machine capable of generating and executing code for the varying platforms, formats, environments, programming languages, etc. The application management module 1063 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 1060 can also include a secondary game module 1064 configured to incorporate a secondary game with a customer loyalty program.

The wagering game system architecture 1000 can also include the secondary content server 1040 configured to provide content and control information for secondary games and other secondary content available on a wagering game network (e.g., secondary wagering game content, promotions content, advertising content, player tracking content, web content, etc.). The secondary content server 1040 can provide "secondary" content, or content for "secondary" games presented on the wagering game machine 1060. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 1040 can provide and control content for community games, including networked games, social games, competitive games, or any other game that multiple players can participate in at the same time. In some embodiments, the secondary content server 1040 can control and present an online website that hosts wagering games. The secondary content server 1040 can also be configured to present multiple wagering game applications on the wagering game machine 1060 via a wagering game website, or other gaming-type venue accessible via the Internet. The secondary content server 1040 can host an online wagering website and/or a social networking website. The secondary content server 1040 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 1040 can also be configured to provide content presentable via an application of the mobile device 1030. In some embodiments, the secondary content server 1040 can also host social networking accounts, provide social networking content, control social networking communications, store associated social contacts, etc. The secondary content server 1040 can also provide chat functionality for a social networking website, a chat application, or any other social networking communications mechanism. In some embodiments, the secondary content server 1040 can utilize player data to determine marketing promotions that may be of interest to a player account. The secondary content server 1040 can also analyze player data and generate analytics for players, group players into demographics, integrate with third party marketing services and devices, etc. The secondary content server 1040 can also provide player data to third parties that can use the player data for marketing. In some embodiments, the secondary content server 1040 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 1000 can also include the online gaming server 1080 configured to control and present a website that hosts gaming related content (e.g., monetary type wagering games, non-monetary type wagering games, social networking content related to gaming, etc.). The online gaming server 1080 can be configured to present multiple applications on the website via the Internet. The online gaming server 1080 can host a social network. The online gaming server 1080 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The online gaming server 1080 can also be configured to provide content presentable via an application of the mobile device 1030. Furthermore, the online gaming server 1080 can include a secondary game module 1081. The secondary game module 1081 can communicate with the secondary game module 1055 to detect achievements from online games and use those achievements in a community game controlled by the wagering game server 1050. The wagering game server 1050 can further link together an online gaming account with a wagering game player account.

The wagering game system architecture 1000 can also include the mobile device 1030 configured to control mobile communications and applications. The mobile device 1030 may also be referred to as a handheld device, a handheld computer or simply handheld. In some embodiments, the mobile device 1030 is a pocket-sized computing device, having a display screen with touch input and/or a miniature keyboard. Some examples of the mobile device 1030 may include, but are not limited to, a smartphone, a personal digital assistant, a mobile computer, a mobile internet device, a portable media player, a mobile phone, a pager, a personal navigation device, etc. In some embodiments, the mobile device 1030 functions via a wireless application protocol (WAP). In some embodiments, the mobile device 1030 may include integrated data capture devices like barcode readers, radio frequency identification (RFID) readers, In-cell Optical LCD readers, and smart card readers. In some embodiments, the mobile device 1030 is configured to communicate with wagering game devices, such as the wagering game server 1050, the wagering game machine 1060, the online gaming server 1080, the secondary content server 1040, and the account server 1070. In some embodiments the mobile device 1030 is personal (i.e., belongs to a user), which the user can carry on their person.

Each component shown in the wagering game system architecture 1000 is shown as a separate and distinct element connected via a communications network 1022. However, some functions performed by one component could be performed by other components. For example, the wagering game server 1050 can also be configured to perform functions of the application management module 1063, and other network elements and/or system devices. Furthermore, the components shown may all be contained in one device, but some, or all, may be included in, or performed by, multiple devices, as in the configurations shown in FIG. 10 or other configurations not shown. For example, the account manager 1053 and the communication unit 1054 can be included in the wagering game machine 1060 instead of, or in addition to, being a part of the wagering game server 1050. Further, in some embodiments, the wagering game machine 1060 can determine wagering game outcomes, generate random numbers, etc. instead of, or in addition to, the wagering game server 1050.

The wagering game machines described herein (e.g., wagering game machine 1060) can take any suitable form, such as floor standing models, handheld mobile wagering game machines, bar-top models, workstation-type console models, surface computing machines, etc. Further, wagering game machines can be primarily dedicated for use in conducting wagering games.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 1000 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 11:
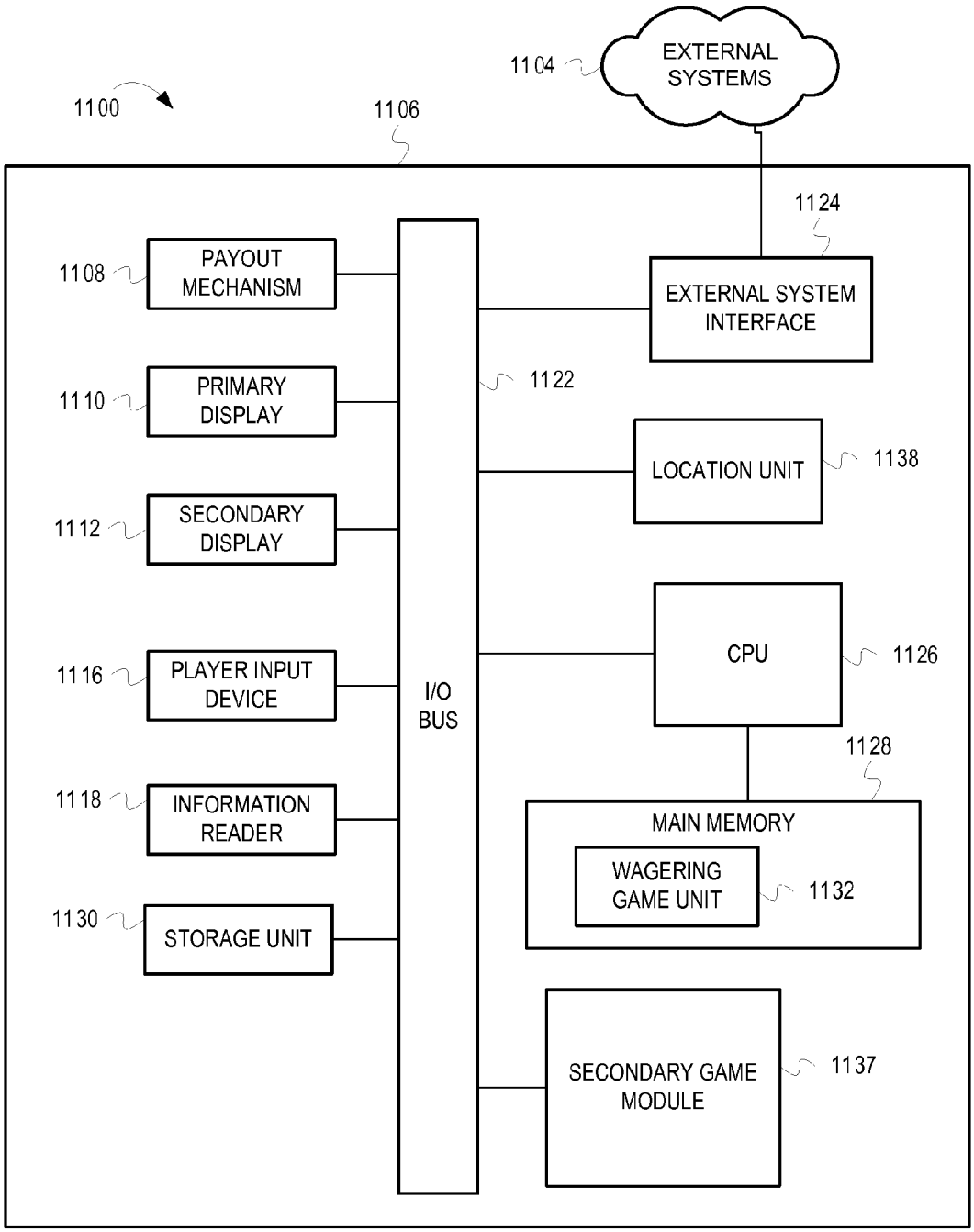
FIG. 11 is an illustration of a wagering game machine architecture 1100, according to some embodiments.

FIG. 11 is a conceptual diagram that illustrates an example of a wagering game machine architecture 1100, according to some embodiments. In FIG. 11, the wagering game machine architecture 1100 includes a wagering game machine 1106, which includes a central processing unit (CPU) 1126 connected to main memory 1128. The CPU 1126 can include any suitable processor, such as an Intel® Pentium processor, Intel® Core 2 Duo processor, AMD Opteron™ processor, or UltraSPARC processor. The main memory 1128 includes a wagering game unit 1132. In some embodiments, the wagering game unit 1132 can present wagering games, such as video poker, video black jack, video slots, video lottery, reel slots, etc., in whole or part.

The CPU 1126 is also connected to an input/output ("I/O") bus 1125, which can include any suitable bus technologies, such as an AGTL+ frontside bus and a PCI backside bus. The I/O bus 1125 is connected to a payout mechanism 1108, primary display 1110, secondary display 1112, value input device 1114, player input device 1116, information reader 1118, and storage unit 1130. The player input device 1116 can include the value input device 1114 to the extent the player input device 1116 is used to place wagers. The I/O bus 1125 is also connected to an external system interface 1124, which is connected to external systems 1104 (e.g., wagering game networks). The external system interface 1124 can include logic for exchanging information over wired and wireless networks (e.g., 802.11g transceiver, Bluetooth transceiver, Ethernet transceiver, etc.)

The I/O bus 1125 is also connected to a location unit 1138. The location unit 1138 can create player information that indicates the wagering game machine's location/movements in a casino. In some embodiments, the location unit 1138 includes a global positioning system (GPS) receiver that can determine the wagering game machine's location using GPS satellites. In other embodiments, the location unit 1138 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 11, in some embodiments, the location unit 1138 is not connected to the I/O bus 1125.

In some embodiments, the wagering game machine 1106 can include additional peripheral devices and/or more than one of each component shown in FIG. 11. For example, in some embodiments, the wagering game machine 1106 can include multiple external system interfaces 1124 and/or multiple CPUs 1126. In some embodiments, any of the components can be integrated or subdivided.

In some embodiments, the wagering game machine 1106 includes a secondary game module 1137. The secondary game module 1137 can process communications, commands, or other information, where the processing can incorporate a secondary game with a loyalty program.

Furthermore, any component of the wagering game machine 1106 can include hardware, firmware, and/or machine-readable storage media including instructions for performing the operations described herein.

Wagering Game System

Figure 12:
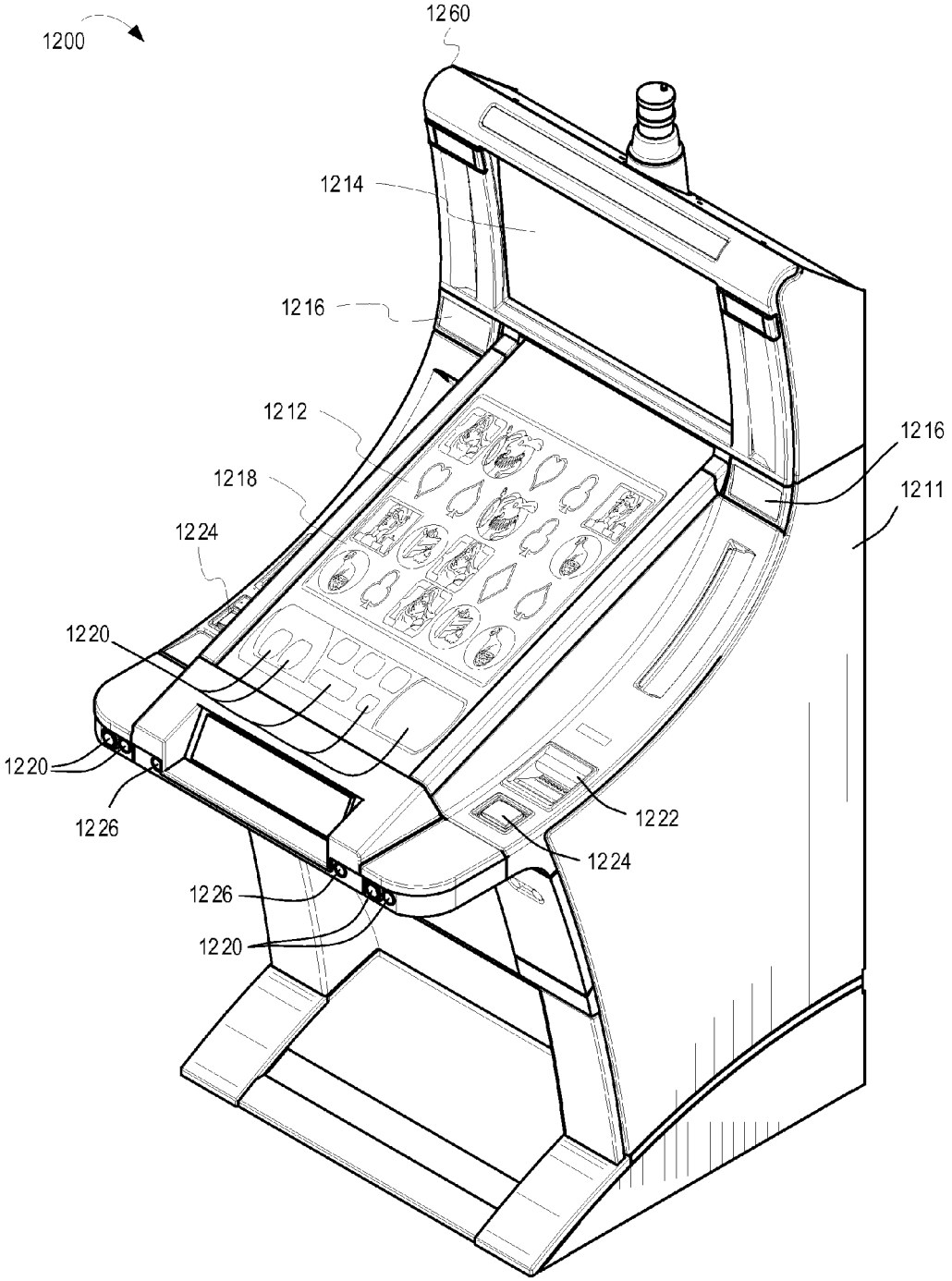
FIG. 12 is an illustration of a wagering game system 1200, according to some embodiments.

FIG. 12 is a conceptual diagram that illustrates an example of a wagering game system 1200, according to some embodiments. In FIG. 12, the wagering game system 1200 includes a wagering game machine 1260 similar to those used in gaming establishments, such as casinos. The wagering game machine 1260 may, in some examples, be referred to as a gaming terminal or an electronic gaming machine. The wagering game machine 1260 may have varying structures and methods of operation. For example, the wagering game machine 1260 may include electromechanical components configured to play mechanical slots. In another example, the 1260 includes electronic components configured to play a video casino game, such as slots, keno, poker, blackjack, roulette, craps, etc. The wagering game machine 1260 is depicted as a floor-standing model. However, other examples of wagering game machines include handheld mobile units, bartop models, workstation-type console models, etc. Further, the wagering game machine 1260 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 1260 illustrated in FIG. 12 comprises a cabinet 1211 that may house various input devices, output devices, and input/output devices. By way of example, the wagering game machine 1260 includes a primary display area 1212, a secondary display area 1214, and one or more audio speakers 1216. The primary display area 1212 or the secondary display area 1214 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 1212 or the secondary display area 1214 includes mechanical reels to display a wagering game outcome. In some example, the primary display area 1212 or the secondary display area 1214 present a transmissive video display disposed in front of a mechanical-reel display to portray a video image superimposed upon the mechanical-reel display. In FIG. 12, the wagering game machine 1260 is a "slant-top" version in which the primary display 1212 is slanted (e.g., at about a thirty-degree angle toward the player of the wagering game machine 1260). Another example of wagering game machine 1260 is an "upright" version in which the primary display 1214 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1260. The wagering game machine 1260 includes a touch screen(s) 1218 mounted over the primary or secondary areas, buttons 1250 on a button panel, bill validator 1252, information reader/writer(s) 1254, and player-accessible port(s) 1256 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 1218, buttons 1250, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form (e.g., software, processing application) readable by a machine (e.g., a computer). For example, machine-readable storage media includes magnetic storage medium (e.g., floppy diskette), read only memory (ROM), random access memory (RAM), magnetic disk storage media, optical storage media (e.g., CD-ROM), magneto-optical storage media, flash memory, erasable programmable memory (e.g., EPROM and EEPROM), or other types of media suitable for storing electronic instructions. In addition, embodiments may be embodied in a machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system, said method comprising:

electronically providing, via a network communication interface of the gaming system, a secondary game for presentation on a display device associated with a wagering game machine, wherein the wagering game machine includes a value input device configured to receive monetary value for placement of one or wagers via user input at the wagering game machine in one or more wagering games available for play via the wagering game machine, wherein a game objective for the secondary game is associated with a set of potential game events that can occur via the one or more wagering games;

electronically determining, by at least one of one or more electronic processing units of the gaming system, occurrence of one of the set of potential game events via one of the one or more wagering games, wherein the occurrence of the one of the set of potential game events causes completion of the game objective for the secondary game, wherein prior to the occurrence of the one of the set of potential game events an identifier for each potential game event from the set of potential game events is assigned to a game space position on a game board for the secondary game, and wherein a location of the game space position on the game board corresponds to a value for an odds of occurrence of the potential game event in the one or more wagering games; and electronically awarding, by at least one of the one or more electronic processing units, a prize associated with a customer loyalty program based on the completion of the game objective.

2. The method of claim 1, wherein the one or more wagering games include a plurality of wagering games that are different in game theme, and wherein at least a portion of game spaces from the game board are assigned to different potential game events from differently themed games.

3. The method of claim 1 further comprising:

associating each of a set of game objectives for the secondary game with different types of events from the one or more wagering games, wherein the game objective is one of the set of game objectives.

4. The method of claim 1, wherein the electronically awarding the prize comprises:

electronically awarding the prize based on a status of a wagering game player account for the customer loyalty program, wherein the one of the one or more wagering games is associated with the wagering game player account.

5. The method of claim 1 further comprising:

electronically assigning the set of potential game events to positions on the game board based on the odds of occurrence in the one or more wagering games for the each potential game event.

6. The method of claim 5, wherein the electronically assigning the set of potential game events to the positions on the game board comprises:

determining, based on electronic analysis of the game board, that a first position on the game board is eligible for a first number of prizes in the secondary game, wherein the game board comprises the first position and a second position eligible for a second number of prizes less than the first number of prizes, electronically assigning a first potential game event of the set of potential game events to the first position in response to determining that the first potential game event of the set of potential game events has first odds of occurrence lower than second odds of occurrence for a second potential game event of the set of potential game events, and electronically assigning the second potential game event to the second position.

7. A gaming system comprising:

one or more processors; and at least one memory device configured to store instructions, which when executed by at least one of the one or more processors, cause the gaming system to perform operations to, electronically provide, for presentation, a secondary game associated with a plurality of wagering game machines, wherein a game objective for the secondary game corresponds to a set of potential game events that can occur via wagering games available for play via the plurality of wagering game machines, wherein the plurality of wagering game machines are associated with a plurality of wagering game player accounts, and wherein each of the plurality of wagering game machines includes a value input device configured to receive monetary value for placement of one or wagers via user input at each wagering game machine in one or more of the wagering games, electronically detect occurrence of one of the set of potential game events from one of the wagering games associated with one of the plurality of wagering game player accounts, wherein prior to the occurrence of the one of the set of potential game events an identifier for each potential game event from the set of potential game events is assigned to a game space position on a game board for the secondary game, and wherein a location of the game space position on the game board corresponds to a value for an odds of occurrence of the potential game event in the wagering games, detect completion of the game objective for the secondary game based on the occurrence of the one of the set of potential game events, and award a prize to any of the plurality of wagering game player accounts that have attained a game space on a first portion of the game board that pertains to the completion of the game objective in response to the completion of the game objective for the secondary game.

8. The gaming system of claim 7, wherein the prize is funded by a customer loyalty program.

9. The gaming system of claim 7, wherein the at least one memory device is configured to store instructions, which when executed by at least one of the one or more processors, cause the gaming system to perform operations to:

associate the game objective with different types of potential game events from the wagering games.

10. The gaming system of claim 7, wherein the at least one memory device is configured to store instructions, which when executed by at least one of the one or more processors, cause the gaming system to perform operations to:

associate the set of potential game events with positions on the game board based on the odds of occurrence in the wagering games for the each potential game event.

11. One or more non-transitory, machine-readable storage media having instructions stored thereon, which when executed by a set of one or more processors of a gaming system cause the gaming system to perform operations comprising:

electronically providing, via a network communication interface of the gaming system, a secondary game for presentation on a display device associated with a wagering game machine, wherein the wagering game machine includes a value input device configured to receive monetary value for placement of one or wagers via user input at the wagering game machine, wherein a game objective for the secondary game is associated with a set of potential game events that can occur via different wagering games available for play via a first of a plurality of wagering game machines;

electronically determining, via the network communication interface, occurrence of one of the set of potential game events via one of the different wagering games, wherein the occurrence of the one of the set of potential game events causes completion of the game objective for the secondary game, wherein prior to the occurrence of the one of the set of potential game events an identifier for each potential game event from the set of potential game events is assigned to a game space position on a game board for the secondary game, and wherein a location of the game space position on the game board corresponds to a value for an odds of occurrence of the potential game event in the different wagering games; and electronically awarding, by at least one of one or more electronic processing units of the gaming system, a prize associated with a customer loyalty program based on the completion of the game objective.

12. The one or more non-transitory, machine-readable storage media of claim 11, said operations further comprising:

providing, for presentation on the display device, the game board, wherein the game board has a plurality of game spaces, and wherein each of the plurality of game spaces on the game board corresponds to at least one of the set of potential game events; and indicating the occurrence of the at least one of the set of potential game events via one of the plurality of game spaces.

13. The one or more non-transitory, machine-readable storage media of claim 12, said operations further comprising:

associating each of the plurality of game spaces with each of the set of potential game events, wherein each of the set of potential game events are different for each of the different wagering games.

14. The one or more non-transitory, machine-readable storage media of claim 13, said operations further comprising:

associating each of the plurality of game spaces with positions on the game board based on the odds of occurrence for the each of the set of potential game events.

15. The one or more non-transitory, machine-readable storage media of claim 14, wherein the operations for associating the each of the plurality of game spaces with the positions on the game board based on the odds of occurrence for the each of the set of potential game events includes operations comprising:

for the each of the plurality of game spaces, determining that the one of the plurality of game spaces is at a first position on the game board eligible for a first number of prizes in the secondary game, wherein the game board comprises at least the first position and a second position eligible for a second number of prizes less than the first number of prizes;

determining that a first potential game event from the set of potential game events has a first odds of occurrence lower than a second odds of occurrence for a second potential game event from the set of potential game events; and assigning the first potential game event to the first position in response to the determining that the first potential game event has the first odds of occurrence lower than the second odds of occurrence.

16. The one or more non-transitory, machine-readable storage media of claim 15, said operations further comprising:

assigning the second potential game event to the second position.

17. The one or more non-transitory, machine-readable storage media of claim 12, wherein the game objective is one of a plurality of game objectives for the secondary game, wherein the plurality of game objectives are associated with a set of the plurality of game spaces arranged in a geometric pattern on the game board, wherein the one of the different wagering games is associated with a wagering game player account, and wherein the operations for electronically awarding the prize includes operations comprising awarding, to the wagering game player account, a number of instances of the prize proportional to a number of the set of the plurality of game spaces attained by the wagering game player account in the geometric pattern.

18. The one or more non-transitory, machine-readable storage media of claim 17, said operations further comprising electronically awarding the prize to a plurality of wagering game player accounts associated with the different wagering games, wherein each of the plurality of wagering game player accounts has attained at least one of the set of the plurality of game spaces.

19. The one or more non-transitory, machine-readable storage media of claim 12, said operations further comprising:

selecting a set of different potential wagering game outcomes indicated in a plurality of rules sets for the different wagering games;

associating each of the set of different potential wagering game outcomes with each of the plurality of game spaces;

associating a set of the plurality of game spaces with the game objective; and associating the game objective with the prize, wherein attainment of one or more portions of the set of different potential wagering game outcomes is configured to complete the game objective.

20. The one or more non-transitory, machine-readable storage media of claim 11, said operations further comprising:

associating a plurality of awards to a type of prize associated with the customer loyalty program, wherein the plurality of awards are associated with different levels of status for the customer loyalty program;

associating the type of prize with the game objective; and electronically awarding one of the plurality of awards based on a level of status for a wagering game player account associated with the wagering game machine, wherein the level of status corresponds to one of the different levels of status for the customer loyalty program.

21. The one or more non-transitory, machine-readable storage media of claim 20, said operations further comprising:

associating first values for the plurality of awards with a first time period;

detecting a change from the first time period to a second time period associated with second values for the plurality of awards different from the first values; and automatically changing the first values to the second values in response to the change from the first time period to the second time period.

22. The gaming system of claim 7, wherein the game board for the secondary game is presented on a common display for the plurality of wagering game machines.

23. The gaming system of claim 7, wherein the first portion of the game board includes a first plurality of game spaces which must be attained before the game objective is completed, wherein a second portion of the game board includes a second plurality of game spaces that do not apply to the game objective, and wherein the at least one memory device is configured to store instructions, which when executed by at least one of the one or more processors, cause the gaming system to perform operations to:

determine, before completion of the game objective, that a first game event occurs in a first of the wagering games associated with a first of the plurality of wagering game player accounts, wherein the first game event is from the set of potential game events, and wherein the first of the wagering games has a first game theme;

indicate, via the game board, that the first of the plurality of wagering game player accounts has attained a first game space in the first plurality of game spaces;

determine that a second game event occurs in a second of the wagering games associated with a second of the plurality of wagering game player accounts, wherein the second game event is from the set of potential game events, and wherein the second of the wagering games is of a second game theme different from the first game theme;

indicate, via the game board, that the second of the plurality of wagering game player accounts has attained a second game space in the first plurality of game spaces, wherein detection of completion of the game objective for the secondary game includes a determination that occurrence of the one of the set of potential game events that corresponds to the second game space completes attainment of a last of the first plurality of game spaces; and award the prize to the first of the plurality of wagering game player accounts and the second of the plurality of wagering game player accounts in response to attainment of the last of the first plurality of game spaces.

* * * * *